US009188932B2

(12) United States Patent
Hayakawa

(10) Patent No.: US 9,188,932 B2
(45) Date of Patent: Nov. 17, 2015

(54) IMAGE FORMING APPARATUS

(71) Applicant: FUJI XEROX CO., LTD., Tokyo (JP)

(72) Inventor: Yuji Hayakawa, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/617,284

(22) Filed: Feb. 9, 2015

(65) Prior Publication Data

US 2015/0248100 A1 Sep. 3, 2015

(30) Foreign Application Priority Data

Mar. 3, 2014 (JP) ..... 2014-040427

(51) Int. Cl.
*G03G 15/00* (2006.01)

(52) U.S. Cl.
CPC ..... *G03G 15/757* (2013.01)

(58) Field of Classification Search
USPC ..... 399/107, 108, 110, 130, 159, 167, 302, 399/308
See application file for complete search history.

(56) References Cited

U.S. PATENT DOCUMENTS 7,437,100 B2 * 10/2008 Kiryu ..... 399/167
8,229,325 B2 * 7/2012 Iwata et al. ..... 399/167
8,503,910 B2 * 8/2013 Matsuda ..... 399/167

FOREIGN PATENT DOCUMENTS

JP 2007114597 A 5/2007

* cited by examiner

*Primary Examiner* — Hoan Tran
(74) *Attorney, Agent, or Firm* — Oliff PLC

(57) ABSTRACT

An image forming apparatus includes a driving unit and a circuit board. The driving unit includes a motor mount section to overlap a first image forming unit of plural image forming units in a rotation-axis direction of photoconductors, and has plural motors that drive the plural photoconductors and plural developing devices forming the image forming units, the intermediate transfer body, and the fixing device, in an assigned manner; and a driving-force transmission section to overlap the other image forming units in the rotation-axis direction, and has a driving-force transmission mechanism that transmits a driving force to the photoconductors and the developing devices forming the other image forming units. The circuit board has a circuit component that controls electric power for operating the driving unit, and is arranged to avoid overlapping the motor mount section and overlap the driving-force transmission section in the rotation-axis direction.

4 Claims, 16 Drawing Sheets

IMAGE FORMING APPARATUS

CROSS-REFERENCE TO RELATED APPLICATIONS

This application is based on and claims priority under 35 USC 119 from Japanese Patent Application No. 2014-040427 filed Mar. 3, 2014.

BACKGROUND

The present invention relates to an image forming apparatus.

SUMMARY

According to an aspect of the invention, there is provided an image forming apparatus including plural arrayed image forming units, an intermediate transfer body, a fixing device, a driving unit, and a circuit board. Each of the image forming units includes a photoconductor on which an electrostatic latent image is formed and a toner image is formed by development while the photoconductor rotates by receiving a driving force; and a developing device that operates by receiving a driving force, and develops the electrostatic latent image on the photoconductor with a toner. The intermediate transfer body circulates on a circulation path including a partial path extending along the plural photoconductors forming the plural image forming units by receiving a driving force, receives first transfer of the toner images formed on the photoconductors, and transport the toner images to a second transfer position. The fixing device operates by receiving a driving force, and fixes the toner images to a sheet of paper, the toner images which are transferred on the sheet from the intermediate transfer body when the toner images pass through the second transfer position. The driving unit includes a motor mount section that extends in a first region overlapping a first image forming unit located at a first end among the plural image forming units in a rotation-axis direction of the photoconductors, and has mounted thereon plural motors that drive the plural photoconductors and the plural developing devices forming the plural image forming units, the intermediate transfer body, and the fixing device, in an assigned manner; and a driving-force transmission section that extends in a second region overlapping the other image forming units excluding the first image forming unit among the plural image forming units in the rotation-axis direction of the photoconductors, and has assembled therein a driving-force transmission mechanism that transmits a driving force to the photoconductors and the developing devices forming the other image forming units. The circuit board has mounted thereon a circuit component that controls electric power for operating the driving unit, the circuit board being arranged at a position to avoid overlapping the motor mount section and to overlap the driving-force transmission section in the rotation-axis direction of the photoconductors.

BRIEF DESCRIPTION OF THE DRAWINGS

An exemplary embodiment of the present invention will be described in detail based on the following figures, wherein.

DETAILED DESCRIPTION

An exemplary embodiment of the invention is described below.

Figure 1:
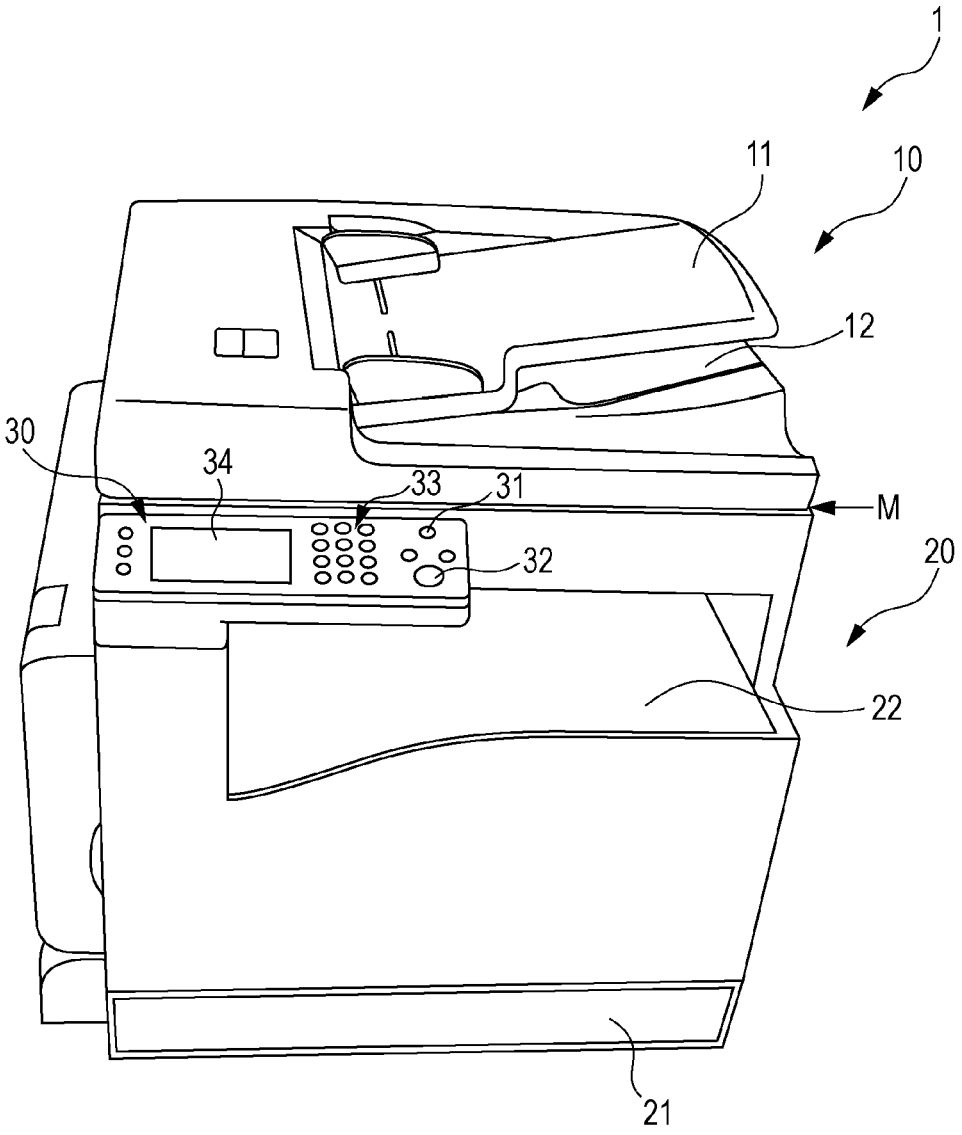
FIG. 1 is an external perspective view of an image forming apparatus according to an exemplary embodiment of the invention.

FIG. 1 is an external perspective view of an image forming apparatus 1 according to an exemplary embodiment of the invention.

The image forming apparatus 1 includes a scanner 10 and a printer 20.

The scanner 10 is a device that reads an image drawn on a document and generates an image signal. Also, the printer 20 is a device that prints an image based on the image signal on a sheet of paper and outputs the sheet.

The scanner 10 includes a document tray 11 and a document output tray 12. When documents are placed on the document tray 11 in a stacked manner and a start button 32 is pressed, the documents are successively fed and read one by one, and are output onto the document output tray 12. Also, the scanner 10 has a hinge (not shown) provided at the far side and extending to the left and right sides, so that an upper portion with respect to an arrow M may be lifted and opened. A transparent glass plate 13 (see FIG. 2) extends immediately below the arrow M. By placing a single document on the transparent glass plate 13 so that a page to be read faces downward, closing the upper portion with respect to the arrow M, and pressing the start button 32, the document on the transparent glass plate 13 may be read.

Also, the printer 20 is a device that successively takes sheets of paper stacked in a paper tray 21 one by one, and prints an image based on an image signal on the taken sheet. The sheet with the image printed is output onto a paper output tray 22. In this exemplary embodiment, the printer 20 is a printer that prints an image on a sheet and outputs the sheet by so-called electrophotographic system.

Also, the image forming apparatus 1 includes a user interface (UI) 30. The UI 30 includes a power supply button 31, the start button 32, other plural press buttons 33, and a touch-panel display screen 34. By operating the UI 30, various instructions, such as an instruction for the number of pints and an instruction for starting an operation, are made. Also, the display screen 34 displays the state of this apparatus and various press buttons. The press buttons displayed on the display screen 34 are also included in subjects to be operated.

Figure 2:
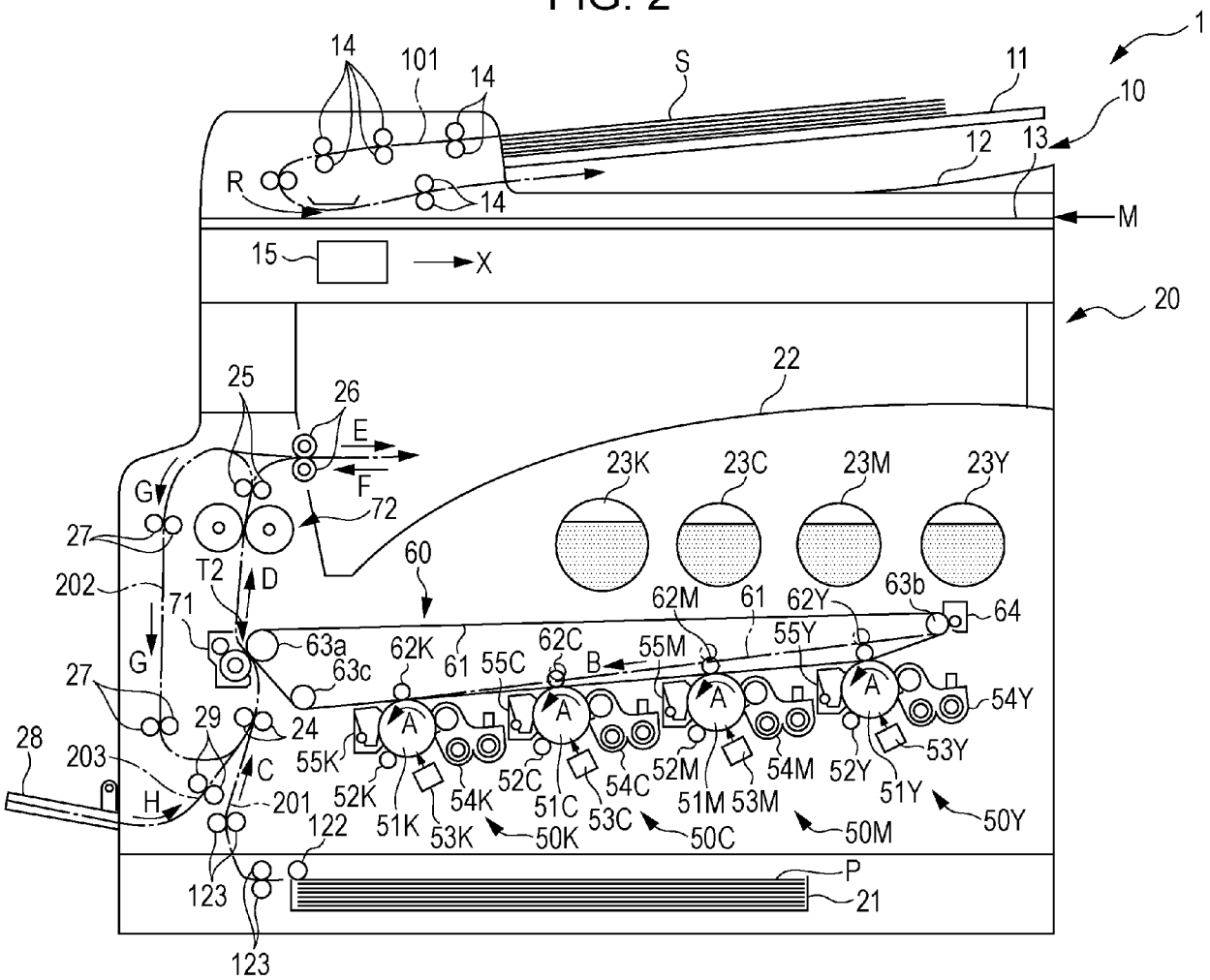
FIG. 2 is a schematic illustration showing an inner configuration of the image forming apparatus whose external appearance is shown in FIG. 1.

FIG. 2 is a schematic illustration showing an inner configuration of the image forming apparatus 1 whose external appearance is shown in FIG. 1.

Documents S placed on the document tray 11 of the scanner 10 are fed one by one when the start button 32 (see FIG. 1) is pressed. The fed document S is transported on a transport path 101 by transport rollers 14. In the middle of the transport, the document S passes through a reading position R at which the document S contacts the transparent glass plate 13. Then, the document S is output onto the document output tray 12. When the document S passes through the reading position R, a reading device 15, which is in a stationary state and faces the reading position R, reads an image recorded on the document S, and converts the read image into an image signal.

Also, the upper portion with respect to the arrow M is opened, a single document is placed on the transparent glass plate 13 so that a page to be read faces downward, the upper portion is closed, and the start button 32 is pressed. In this case, the reading device 15 reads the document on the transparent glass plate 13 while moving in an arrow X direction, and converts the read result into an image signal.

The printer 20 includes four image forming units 50Y, 50M, 50C, and 50K arrayed in a substantially single row. The image forming units 50Y, 50M, 50C, and 50K are image forming units that respectively form toner images with toners of respective colors including yellow (Y), magenta (M), cyan (C), and black (K). In this case, when common portions of the image forming units 50Y, 50M, 50C, and 50K are described, the characters Y, M, C, and K provided for distinguishing the colors of toners are omitted, and the image forming units 50Y, 50M, 50C, and 50K are expressed as image forming units 50. Components other than the image forming units are also similarly treated.

Each image forming unit 50 includes a photoconductor 51. An electrostatic latent image is formed on the surface of the photoconductor 51 while the photoconductor 51 rotates in an arrow A direction by receiving a driving force. Further, a toner image is formed by development.

A charging device 52, an exposure device 53, a developing device 54, a first transfer device 62, and a cleaner 55 are provided around each photoconductor 51 forming each image forming unit 50. The first transfer device 62 is arranged at a position at which the first transfer device 62 and the photoconductor 51 pinch an intermediate transfer belt 61 (described later). The first transfer device 62 is an element that is not included in the image forming unit 50, but is included in an intermediate transfer unit 60 (described later).

The charging device 52 uniformly charges the surface of the photoconductor 51 with electricity.

The exposure device 53 irradiates the uniformly charged photoconductor 51 to exposure light modulated in accordance with an image signal, and hence forms an electrostatic latent image on the photoconductor 51.

The developing device develops the electrostatic latent image formed on the photoconductor 51 with a toner of a color corresponding to one of the image forming units 50Y, 50M, 50C, and 50K, and hence forms a toner image on the photoconductor 51.

The first transfer device 62 transfers the toner image formed on the photoconductor 51, onto the intermediate transfer belt 61 (described later).

the cleaner 55 removes the remaining toner and the like on the photoconductor 51 after the transfer, from the surface of the photoconductor 51.

In this case, in the image forming apparatus 1 according to this exemplary embodiment, in each of the image forming units 50Y, 50M, 50C, and 50K, the photoconductor 51, the charging device 52, and the cleaner 55 form a single module. In this case, the module is called photoconductor module. The photoconductor module is removably mounted in an apparatus housing (not shown) that is a frame of the image forming apparatus 1.

The exposure device 53 forms a single module for each of the image forming units 50Y, 50M, 50C, and 50K. In this case, this module is called exposure module.

Further, the developing device 54 forms a single module for each of the image forming units 50Y, 50M, 50C, and 50K. In this case, the module is called developing module. The exposure module and the developing module are also removably mounted in the apparatus frame of the image forming apparatus 1.

The intermediate transfer unit 60 is arranged above the four image forming units 50. The intermediate transfer unit 60 includes the intermediate transfer belt 61. The intermediate transfer belt 61 is supported by plural rollers, such as a driving roller 63*a*, a driven roller 63*b*, and a support roller 63*c*. The intermediate transfer belt 61 is driven by the driving roller 63*a* and circulates in an arrow B direction on a circulation path including a path extending along the four photoconductors 51 forming the four image forming units 50Y, 50M, 50C, and 50K.

The toner images on the respective photoconductors 51 are successively transferred to be superposed on the intermediate transfer belt 61 by the action of the first transfer devices 62. Then, the toner images transferred on the intermediate transfer belt 61 are transported by the intermediate transfer belt 61 to a second transfer position T2. A second transfer device 71 is arranged at the second transfer position T2. The toner images on the intermediate transfer belt 61 are transferred on a sheet P of paper transported to the second transfer position T2 by the action of the second transfer device 71. The transport of the sheet P is described later. A cleaner 64 removes the toner and the like remaining on the intermediate transfer belt 61 after the transfer of the toner images on the sheet P from the intermediate transfer belt 61.

In this case, the printer 20 has a monochrome mode in which a toner image is formed with the toner of black (K) and in which a monochrome image is printed on a sheet P by using only the image forming unit 50K that is located at a first end of the array (end at the leftmost side in FIG. 2) and a color mode in which a color image is printed on a sheet P by using the four image forming units 50Y, 50M, 50C, and 50K. The circulation path of the intermediate transfer belt 61 is changed by using a cam mechanism (not shown), to move while contacting the four photoconductors 51 forming the four image forming units 50Y, 50M, 50C, and 50K in the color mode, and to move while contacting only the photoconductor 51K of the image forming unit 50K located at the first end of the array (the end at the leftmost side in FIG. 2) and being separated from the photoconductors 51Y, 51M, and 51C of the other image forming units 50Y, 50M, and 50C in the monochrome mode. In the monochrome mode, the operations of the image forming units 50Y, 50M, and 50C other than the image forming unit 50K are stopped, to reduce power consumption and increase the life of components.

Toner cartridges 23 housing toners of the respective colors are arranged above the intermediate transfer unit 60. When a toner in a developing device 54 is consumed, the toner is supplied to the developing device 54 from the toner cartridge 23 housing the toner of a corresponding color. Each toner cartridge 23 is removably mounted. When a toner cartridge 23 becomes empty, a new toner cartridge 23 is mounted.

Also, the paper tray 21 is arranged in a bottom portion of the printer 20. The paper tray 21 houses sheets P of paper before printing in a stacked manner. The paper tray 21 is allowed to be pulled out for supplement of sheets of paper or replacement.

A single sheet P is taken by a pickup roller 122 from the paper tray 21, the sheet P is transported on a transport path 201 in an arrow C direction by transport rollers 123 to timing control rollers 24. The sheet P transported to the timing control rollers 24 is sent to the second transport position T2 by the timing control rollers 24 so that the sheet P reaches the second transfer position T2 in synchronization with a timing at which a toner image on the intermediate transfer belt 61 reaches the second transfer position T2. The sheet P sent by the timing control rollers 24 receives transfer of the toner image from the intermediate transfer belt 61 by the action of the second transfer device 71 at the second transfer position T2. The sheet P which has received the transfer of the toner image is further transported in an arrow D direction and passes through a fixing device 72. The toner image on the sheet P receives heat and pressure by the fixing device 72 and is fixed to the sheet P. Accordingly, an image formed of the fixed toner image is printed on the sheet P. The sheet which has received the fixing of the toner image by the fixing device 72 is further transported by transport rollers 25, and is output onto the paper output tray 22 by paper output rollers 26.

The printer 20 has a duplex print mode in which images are printed on both surfaces of a sheet P. In the duplex print mode, an image is printed on a first surface of a sheet P in the above-described manner, and then the sheet P with the image printed on the first surface is sent in an arrow E direction by the paper output rollers 26 to a middle position toward the paper output tray 22. Then, the rotation direction of the paper output rollers 26 is reversed, to return the sheet P, which has been sent to the middle position toward the paper output tray 22, in an arrow F direction. The sheet P returned by the reverse rotation of the paper output rollers 26 is transported in a direction indicated by an arrow G on a transport path 202 by transport rollers 27, and reaches the timing control rollers 24 again. At this time, the sheet P is in a state in which the front side and the back side are inverted as compared with the situation in which the image is printed on the first surface. After the sheet P reaches the timing control rollers 24 again, an image is printed similarly except that the image is printed on the second surface of the sheet P. The sheet P with the images printed on both surfaces in this way is sent by the paper output rollers 26, onto the paper output tray 22.

Also, a manual feed tray 28 is arranged at the printer 20. When a sheet is placed on the manual feed tray 28 and the start button 32 is pressed, the sheet on the manual feed tray 28 is transported in an arrow H direction on a transport path 203 by transport rollers 29, and reaches the timing control rollers 24. The successive print operation is similar to the print operation that is provided on a sheet P taken from the paper tray 21.

Figure 3:
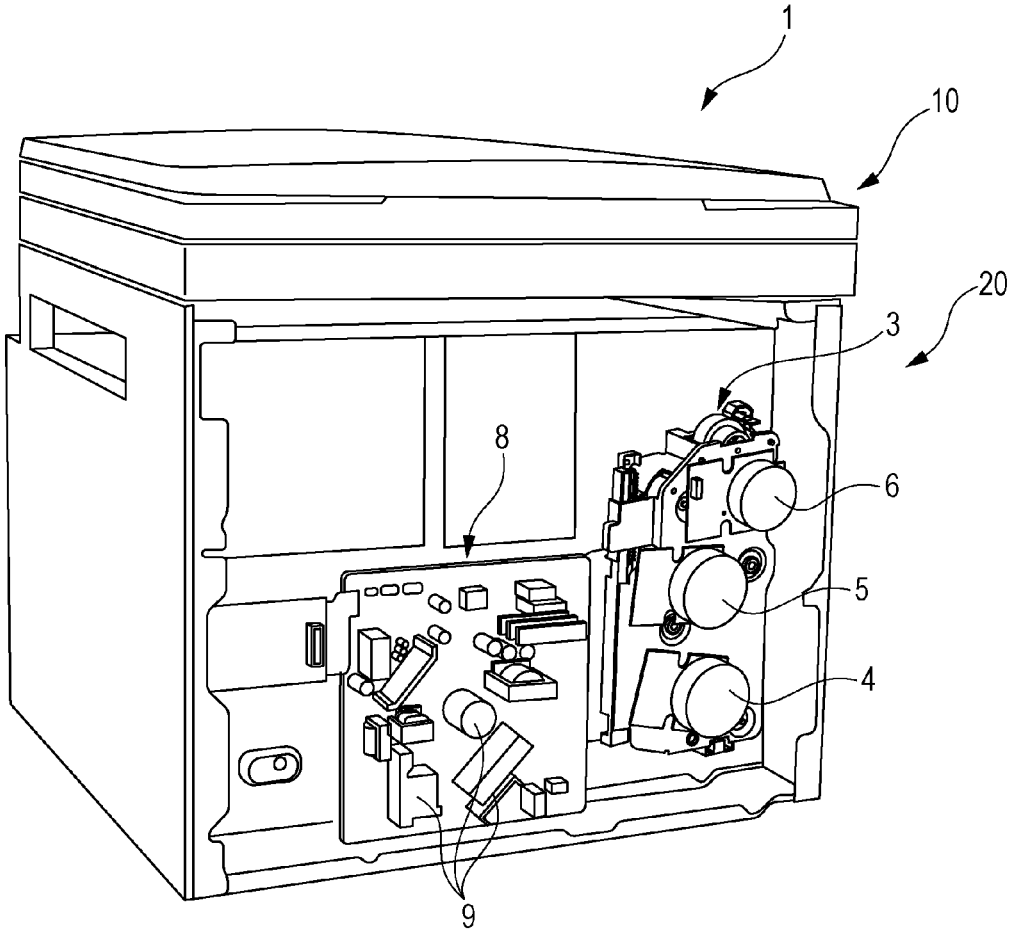
FIG. 3 is a perspective view showing the inside viewed from the rear side when a rear surface covering of the image forming apparatus shown in FIG. 1 is removed.

FIG. 3 is a perspective view showing the inside viewed from the rear side when a rear surface covering of the image forming apparatus 1 shown in FIG. 1 is removed.

FIG. 3 shows a driving unit 3 and a circuit board 8 mounted on the printer 20.

The driving unit 3 includes mounted thereon three motors of a first motor 4, a second motor 5, and a third motor 6 that drive elements of the printer 20 in an assigned manner. Also, the circuit board 8 includes mounted thereon a circuit component 9 that controls electric power for operating the driving unit 3 and other elements.

Figure 4:
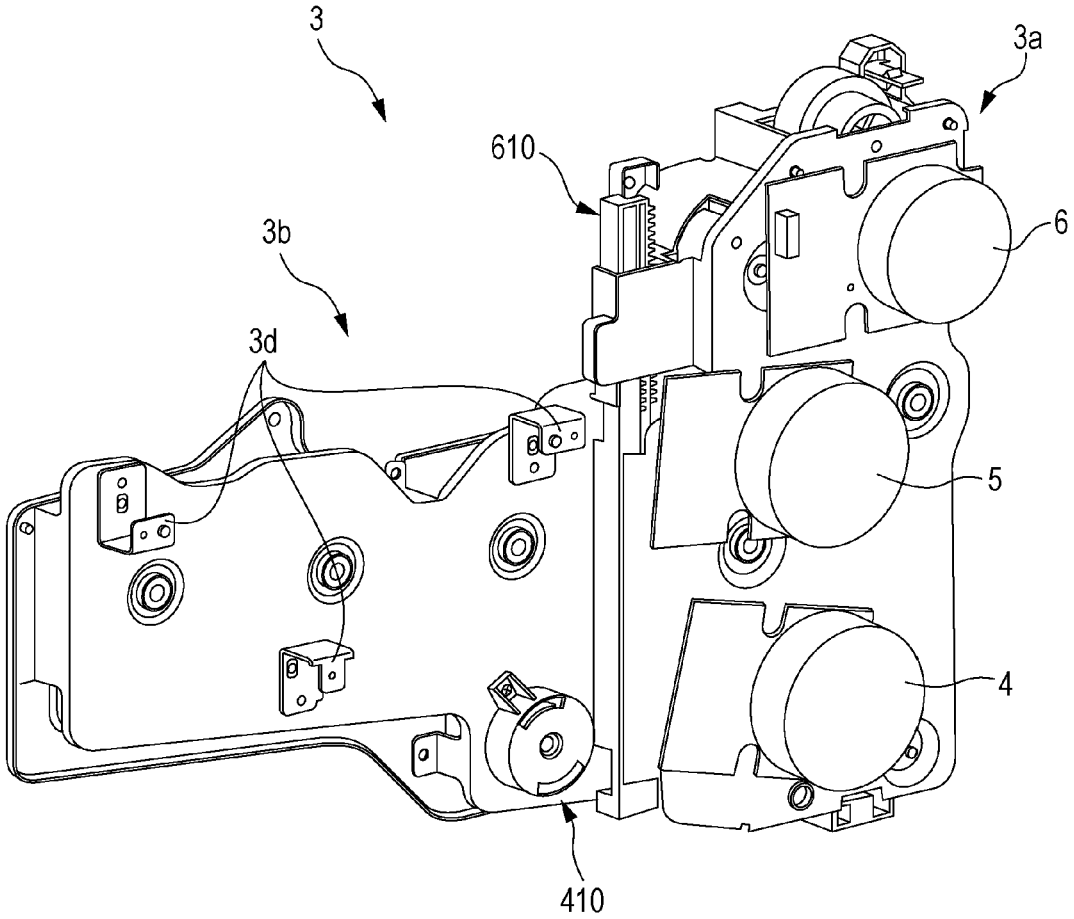
FIG. 4 is a perspective view of a driving unit.

FIG. 4 is a perspective view of the driving unit 3.

The driving unit 3 includes a motor mount section 3*a* having the three motors 4, 5, and 6 mounted thereon and shown in FIG. 3, and a driving-force transmission section 3*b* hidden behind the circuit board 8 in FIG. 3.

The motor mount section 3*a* of the driving unit 3 is arranged in a region overlapping the single image forming unit 50K that forms a toner image with the toner of black color (K) and arrayed at the leftmost side in FIG. 2 among the four image forming units 50Y, 50M, 50C, and 50K shown in FIG. 2 (in this case, this region is referred to as "first region"). The single image forming unit 50K is an image forming unit that is used in both the monochrome mode and the color mode. The driving-force transmission section 3*b* in the driving unit 3 is arranged in a second region overlapping the other image forming units 50Y, 50M, and 50C excluding the single image forming unit 50K among the four image forming units 50Y, 50M, 50C, and 50K. The other image forming units 50Y, 50M, and 50C excluding the image forming unit 50K are image forming units that are not used in the monochrome mode, but are used only in the color mode. In FIGS. 3 and 4, since the image forming apparatus 1 is viewed from the rear side, the motor mount section 3*a* is arranged at the right side and the driving-force transmission section 3*b* is arranged at the left side, in a manner reversal to the arrangement relationship in FIG. 2.

The three motors 4, 5, and 6 mounted on the motor mount section 3*a* operate respective corresponding portions of the image forming apparatus 1 in an assigned manner. However, the image forming apparatus 1 includes two motors serving as power sources for supplying the toners of the developing devices 54 from the toner cartridges 23 shown in FIG. 2, in addition to the three motors 4, 5, and 6. The two motors take charge of driving toner supply paths being different for forward rotation and reverse rotation. Hence, the two motors take charge of supplement of the toners from the four toner cartridges 23 to the four developing devices 54. The two motors are small motors, and do not relate to the characteristics of this exemplary embodiment. Therefore, the two motors are not described any more in the following description.

The three motors 4, 5, and 6 of the driving unit 3 shown in FIGS. 3 and 4 drive the four photoconductors 51 and the four developing devices 54 forming the four image forming units 50Y, 50M, 50C, and 50K, the intermediate transfer unit 60, the fixing device 72, and the paper transport paths, in an assigned manner, in the printer 20 except for the above-described toner supplement paths.

To be specific, the first motor 4 takes charge of driving of the four developing devices 54 and paper transport at a paper feed side. The second motor 5 takes charge of rotation driving of the four photoconductors 51 and circulation of the intermediate transfer belt 61. Further, the third motor 6 takes charge of the fixing device 72 and paper transport at a paper output side. The third motor 6 also takes charge of switching of driving between the monochrome mode and the color mode. Although the details are described later, the third motor 6 executes switching from the monochrome mode to the color mode, and switching from the color mode to the monochrome mode, by rotation in the same direction.

The three motors 4, 5, and 6 require large driving forces, and have large external sizes. Hence, the motor mount section 3*a* has a markedly larger thickness in the rotation-axis direction of the photoconductors 51 (see FIG. 2) than that of the driving-force transmission section 3*b* in the driving unit 3.

In this exemplary embodiment, the three motors 4, 5, and 6 with large sizes assembled in the printer 20 are mounted on the single driving unit 3, and further are collected at a single portion in the driving unit 3 (the motor mount section 3*a*). Accordingly, as shown in FIG. 3, the three motors 4, 5, and 6 are arranged in a distributed manner so as not to overlap the circuit board 8 in the thickness direction (the rotation-axis direction of the photoconductors 51).

Also, the driving-force transmission section 3*b* has mounted thereon a driving-force transmission mechanism (described later) that takes charge of driving-force transmission to the photoconductors 51 and the developing devices 54 of the other image forming units 50Y, 50M, and 50C used only in the color mode, excluding the single image forming unit 50K among the four image forming units 50Y, 50M, 50C, and 50K. The motor mount section 3*a* takes charge of driving-force transmission to the photoconductor 51 and the developing device 54 of the single image forming unit 50K used in both the monochrome mode and the color mode. Hence, the motor mount section 3*a* is arranged at a position to overlap the single image forming unit 50K.

Also, a driving-force switching member 610 is provided at a boundary portion between the motor mount section 3*a* and the driving-force transmission section 3*b* of the driving unit 3. The driving-force switching member 610 is a member that is driven by the third motor 6 and switches the state of the driving force to the driving-force transmission section 3*b* between transmission and shutoff. That is, the driving-force switching member 610 is a member that transmits the driving force to the driving-force transmission section 3*b* in the color mode, and shuts off the transmission of the driving force to the driving-force transmission section 3*b* in the monochrome mode. Also, a driving-force switching mechanism 410 for developing device is also shown. The details of the driving-force switching mechanism 410 are described later.

The driving-force transmission mechanism mounted on the driving-force transmission section 3*b* is roughly divided into a first transmission mechanism that transmits the driving force of the first motor 4 to the developing devices 54Y, 54M, and 54C of the three image forming units 50Y, 50M, and 50C, and a second transmission mechanism that transmits the driving force of the second motor 5 to the photoconductors 51Y, 51M, and 51C of the three image forming units 50Y, 50M, and 50C. The driving-force switching member 610 simultaneously executes switching the state between transmission and shut-off of the driving force of the first motor 4 to the first transmission mechanism, and switching the state between transmission and shut-off of the driving force of the second motor 5 to the second transmission mechanism. The driving-force switching member 610 further executes switching of the circulation path of the intermediate transfer belt 61 (see FIG. 2) in the monochrome mode and the color mode. That is, the driving-force switching member 610 executes switching of a cam mechanism (not shown) so that the intermediate transfer belt 61 including a portion which contacts the four photoconductors 51Y, 51M, 51C, and 51K forming the four image forming units 50Y, 50M, 50C, and 50K circulates in the color mode, and the intermediate transfer belt 61 including a portion which contacts only the single photoconductor 51K forming the single image forming unit 50K but being separated from the three photoconductors 51Y, 51M, and 51C forming the other three image forming units 50Y, 50M, and 50C circulates in the monochrome mode.

Next, the circuit board 8 shown in FIG. 3 is described.

The circuit board 8 is a circuit board having mounted thereon the circuit component 9 that controls electric power to be supplied to the driving unit 3 and electric power to be supplied to respective elements of the printer 20. The circuit board 8 is arranged at a position to avoid the circuit board 8 from overlapping the motor mount section 3*a* of the driving unit 3, and to overlap the driving-force transmission section 3*b*.

Figure 5:
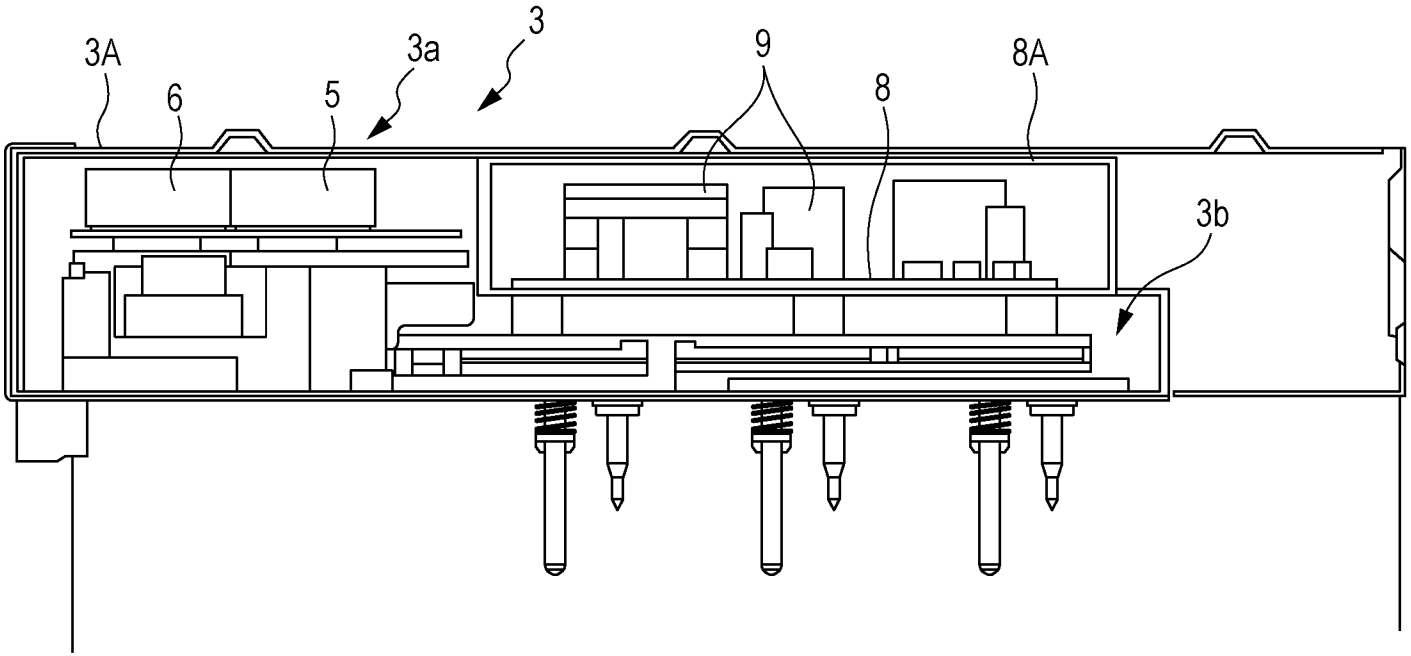
FIG. 5 is a cross-sectional view showing a portion of the driving unit and a circuit board when viewed from the upper side of the image forming apparatus.

FIG. 5 is a cross-sectional view showing a portion of the driving unit 3 and the circuit board 8 when viewed from the upper side of the image forming apparatus 1. In FIG. 5, a frame 3A indicates a volume portion occupied by the driving unit 3, and a frame 8A indicates a volume portion occupied by the circuit board 8 including the circuit component 9.

The circuit board 8 is arranged at a position to overlap the driving-force transmission section 3*b* and to reduce the difference between the thickness of the driving-force transmission section 3*b* and the thickness of the motor mount section 3*a*, and the circuit board 8 is fixed to the driving-force transmission section 3*b*. As shown in FIG. 4, the driving-force transmission section 3*b* includes brackets 3*d* for circuit-board fixture. The circuit board 8 is fixed to the brackets 3*d*. The thickness of the entire portion of the driving-force transmission section 3*b* including the circuit board 8 (the dimension in the rotation-axis direction of the photoconductors 51) is within substantially the same thickness as the thickness of the motor mount section 3*a*, thereby contributing to reduction in thickness of the printer 20 and to space saving.

Also, the driving-force transmission section 3*b* of the driving unit 3 according to this exemplary embodiment is used only in the color mode, and only the motor mount section 3*a* is used in the monochrome mode. Hence, the motor mount section 3*a* of the driving unit 3 may be applied to a printer having only the monochrome mode.

Next, driving-force transmission and switching mechanisms of the driving unit 3 according to this exemplary embodiment are described.

Figure 6:
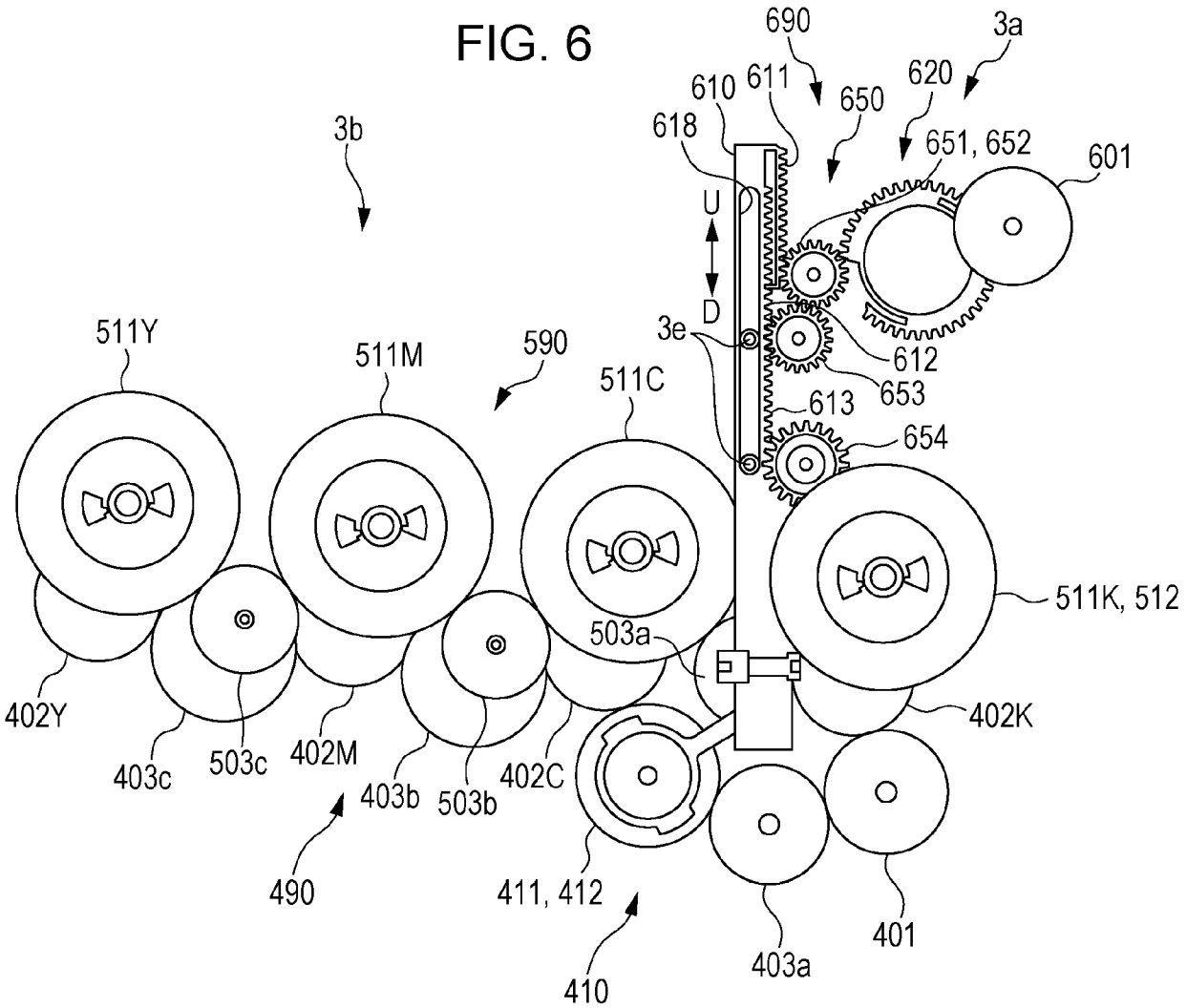
FIG. 6 is a schematic illustration showing an overview of driving-force transmission and switching mechanisms of the driving unit.

FIG. 6 is a schematic illustration showing an overview of driving-force transmission and switching mechanisms of the driving unit 3.

Arranged here is a driving-force switching mechanism 690 that switches the state of the driving force between transmission and shut-off in the monochrome mode and the color mode. The driving-force switching mechanism 690 includes the driving-force switching member 610. The driving-force switching member 610 has formed therein a groove 618 extending in directions indicated by arrows U and D. Two pins 3*e* are inserted into the groove 618. The pins 3*e* are fixed to a base body of the driving unit 3 (see FIG. 4). The driving-force switching member 610 moves straight in the directions indicated by arrows U and D while being guided by the two pins 3*e*. The driving-force switching mechanism 690 includes a driving gear 601. The driving force of the third motor 6 shown in FIG. 4 is transmitted first to the driving gear 601 among members shown in FIG. 6. Then, the driving force transmitted to the driving gear 601 is transmitted to the driving-force switching member 610 through a tooth lacking gear 620 and the like, and moves the driving-force switching member 610 in the directions indicated by arrows U and D.

FIG. 6 also shows a transmission gear 401 to which the driving force from the first motor 4 shown in FIG. 4 is transmitted first among the members shown in FIG. 6. The transmission gear 401 meshes with both a driving gear 402K and an intermediate gear 403*a*. The driving gear 402K is a gear that is coupled to the developing device 54K forming the image forming unit 50K (see FIG. 2) configured to form a toner image with the toner of black color (K), and drives the single developing device 54K. That is, the driving force from the first motor 4 is transmitted to the developing device 54K through the transmission gear 401 and the driving gear 402K.

Figure 10:
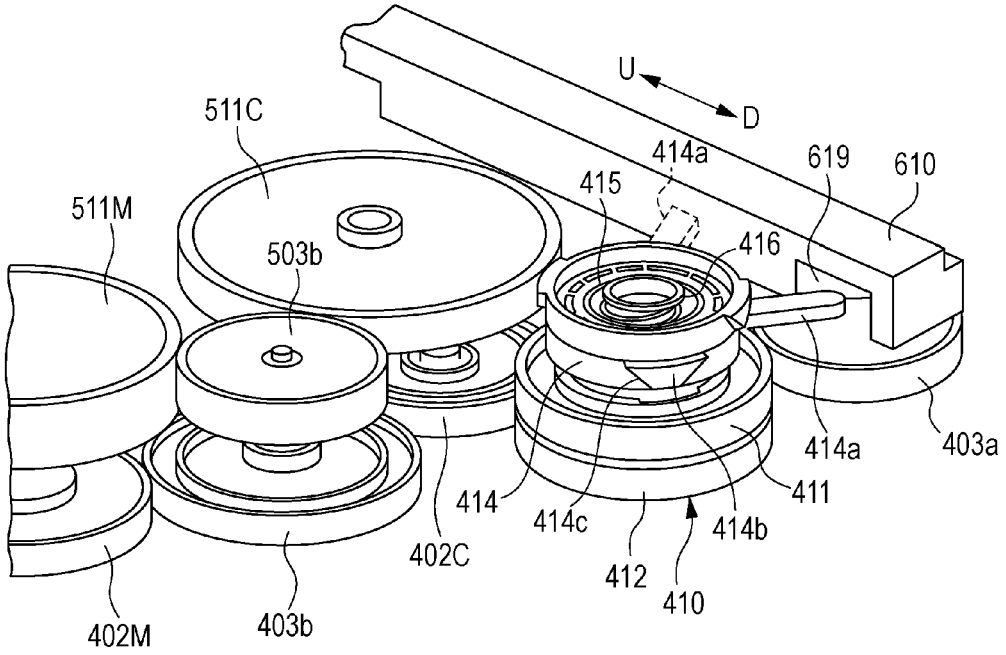
FIG. 10 is a perspective view showing a driving-force switching mechanism for developing device when a covering member thereof is removed and the inner structure is viewed.

Also, the intermediate gear 403*a* meshes with a driving gear 411 forming the driving-force switching mechanism 410 for developing device. Hence, the driving force of the first motor 4 transmitted to the transmission gear 401 is transmitted to the driving gear 402K that drives the developing device 54K, and is also transmitted to the driving gear 411 of the driving-force switching mechanism 410 through the intermediate gear 403*a*. As shown in FIG. 10 (described later), the driving-force switching mechanism 410 includes the driving gear 411 and a transmission gear 412 that are coaxially provided. The driving-force switching mechanism 410 has a structure that transmits the driving force transmitted to the driving gear 411 to the transmission gear 412 in the color mode and shuts off the transmission of the driving force in the monochrome mode, by up-down movement (movement in the directions indicated by arrows U and D) of the driving-force switching member 610. The driving force transmitted to the transmission gear 412 in the color mode is transmitted to a driving gear 402C that drives the developing device 54C of the image forming unit 50C which forms a toner image with the toner of cyan color (C), and is further transmitted to a driving gear 402M that drives the developing device 54M of the image forming unit 50M which forms a toner image with the toner of magenta color (M) through an intermediate gear 403*b*. The driving force transmitted to the driving gear 402M is further transmitted to a driving gear 402Y that drives the developing device 54Y of the image forming unit 50Y which forms a toner image with the toner of yellow color (Y) through an intermediate gear 403*c*. The driving gears 402C, 402M, and 402Y that drive the developing devices 54C, 54M, and 54Y of the total three image forming units 50C, 50M, and 50Y which form respective toner images of cyan color (C), magenta color (M), and yellow color (Y), and the intermediate gears 403*b* and 403*c* that transfer the driving force transmitted to the driving gears 402C, 402M, and 402Y form a first transmission mechanism 490.

Figure 8A:
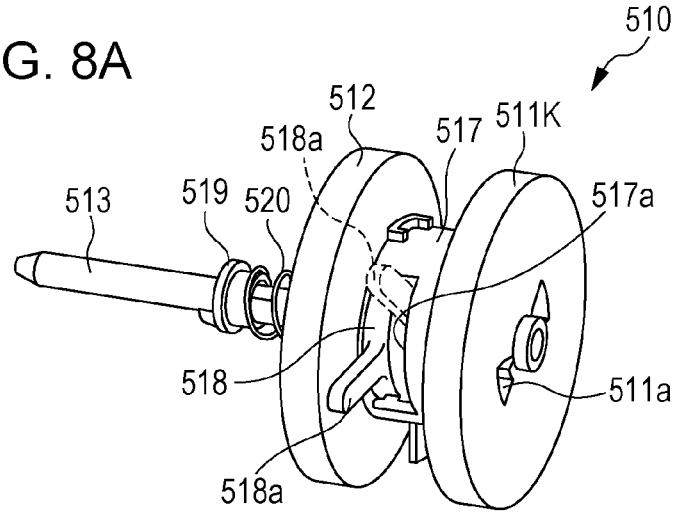
FIGS. 8A to 8C are each a perspective view of the driving-force switching mechanism for photoconductor.
Figure 8B:
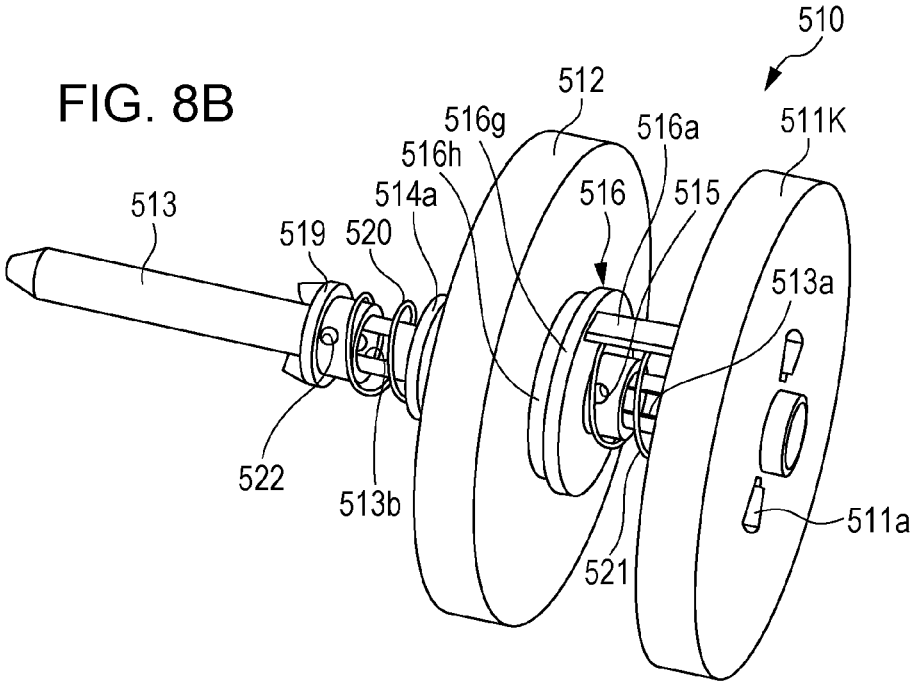
Figure 8C:
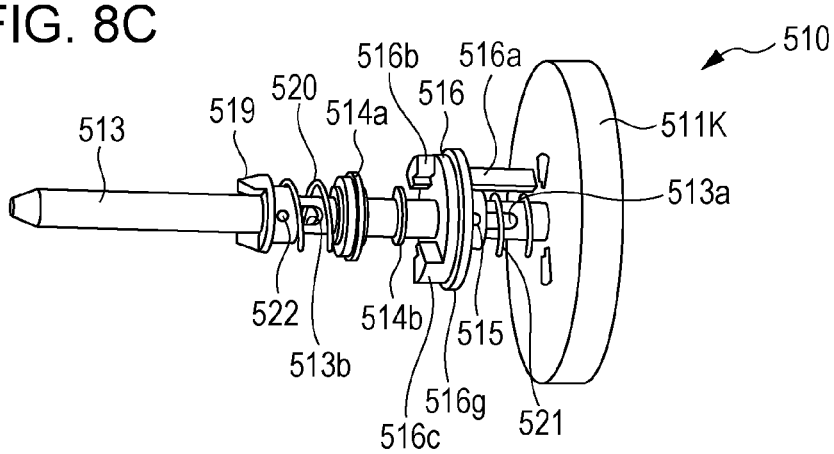

Further, FIG. 6 shows a driving gear 511K that drives the photoconductor 51K forming the image forming unit 50K (see FIG. 2) which forms a toner image with the toner of black color (K). The driving force from the second motor 5 shown in FIG. 4 is transmitted first to the driving gear 511K among the members shown in FIG. 6. The driving gear 511K is a gear assembled in a driving-force switching mechanism 510 for photoconductor. The driving-force switching mechanism 510 for photoconductor further includes a transmission gear 512 arranged coaxially with the driving gear 511K as shown in FIGS. 8A to FIG. 8C (described later). The driving-force switching mechanism 510 has a structure that transmits the driving force transmitted from the second motor 5 to the driving gear 511K, to the transmission gear 512 in the color mode and shuts off the transmission of the driving force in the monochrome mode, by up-down movement (movement in the directions indicated by arrows U and D) of the driving-force switching member 610.

Figure 7:
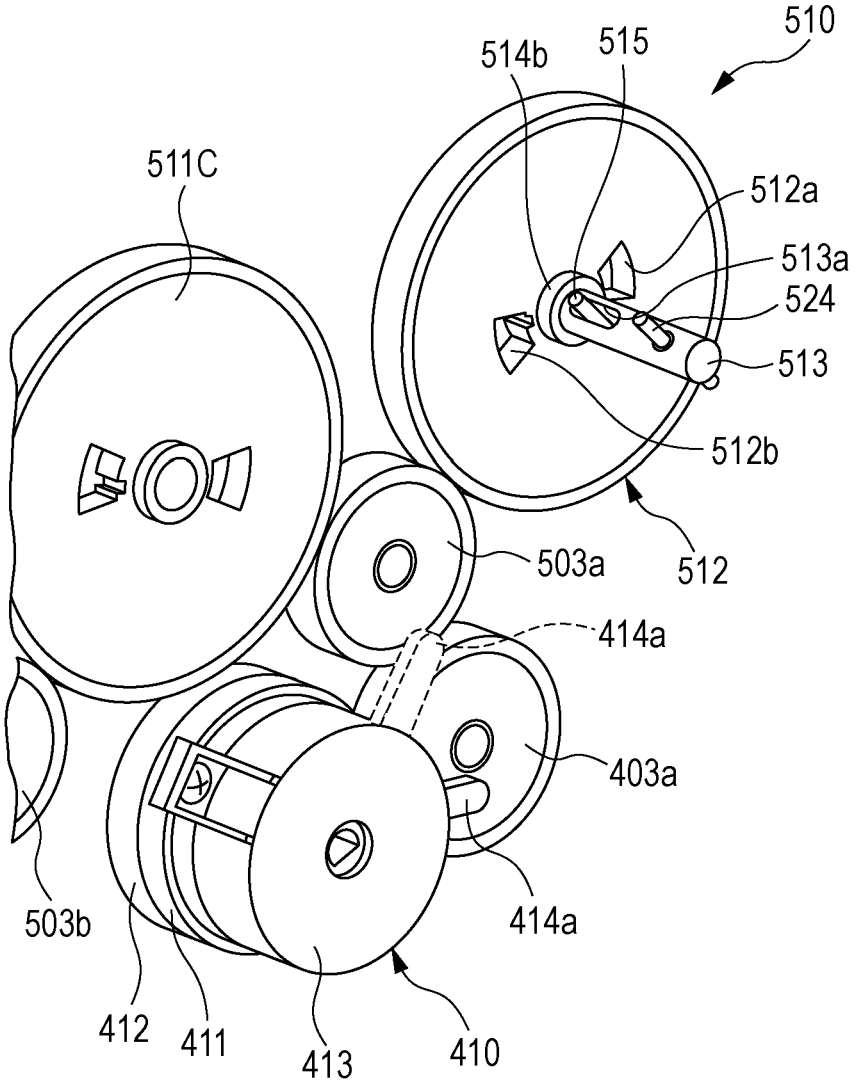
FIG. 7 is a perspective view showing a driving-force transmission mechanism from a transmission gear forming a driving-force switching mechanism for photoconductor to a downstream portion.

FIG. 7 is a perspective view showing a driving-force transmission mechanism from the transmission gear 512 forming the driving-force switching mechanism 510 for photoconductor to a downstream portion. FIG. 7 also shows an external appearance of the driving-force switching mechanism 410 for developing device.

The driving force is transmitted from the driving gear 511K (see FIGS. 6 and 8) in the color mode to the transmission gear 512 of the driving-force switching mechanism 510 for photoconductor. The driving force transmitted to the transmission gear 512 is transmitted to a driving gear 511C that drives the photoconductor 51C of the image forming unit 50C which forms a toner image with the toner of cyan color (C) through an intermediate gear 503*a*, and hence the photoconductor 51C is driven. Also, the driving force transmitted to the driving gear 511C is further transmitted to a driving gear 511M that drives the photoconductor 51M of the image forming unit 50M (see FIG. 2) which forms a toner image of magenta color (M) shown in FIG. 6 through an intermediate gear 503*b*, and hence the photoconductor 51M is driven. Further, the driving force is transmitted to a driving gear 511Y that drives the photoconductor 51Y of the image forming unit 50Y (see FIG. 2) which forms a toner image of yellow color (Y) through an intermediate gear 503*c*, and hence the photoconductor 51Y is driven.

The three intermediate gears 503*a*, 503*b*, and 503*c*, and the three driving gears 511C, 511M, and 511Y form a second transmission mechanism 590.

Referring back to FIG. 7, elements shown in FIG. 7, which are required for later description, are described.

A driving shaft 513 that drives the photoconductor 51K penetrates through the transmission gear 512 of the driving-force switching mechanism 510 for photoconductor. The transmission gear 512 is rotatable relative to the driving shaft 513. However, the transmission gear 512 is sandwiched between two annular members 514*a* and 514*b* (see FIG. 8C, FIG. 7 only showing one annular member 514*b*, see FIG. 8C for the other annular member 514*a*) fixed to the driving shaft 513, and hence is not movable in the axial direction of the driving shaft 513. Also, the transmission gear 512 has two recessed portions 512*a* and 512*b* formed at positions mutually different by 180 degrees in the circumferential direction. The two recessed portions 512*a* and 512*b* have slightly different dent shapes. The reason is described later.

Also, a pin 524 penetrates through the driving shaft 513. The pin 524 is a pin that fixes the driving gear 511K (see FIGS. 8A to 8C, not shown in FIG. 7) to the driving shaft 513.

Also, the driving shaft 513 has a long hole 513*a* formed therein. The long hole 513*a* extends in the axial direction. A pin 515 is inserted into the long hole 513*a*. The pin 515 is fixed to a coupling member 516 shown in FIG. 9A (see FIGS. 8B and 8C). Hence, the coupling member 516 is movable in the axial direction relative to the driving shaft 513 by a length of the long hole 513*a*. Residual elements of the driving-force switching mechanism 510 for photoconductor are described later.

FIG. 7 also shows an external appearance of the driving-force switching mechanism 410 for developing device.

FIG. 7 shows the driving gear 411 forming the driving-force switching mechanism 410, and the transmission gear 412 to which the driving force is transmitted from the driving gear 411 or from which the driving force is shut off. As elements of the driving-force switching mechanism 410 for developing device, FIG. 7 further shows a covering member 413 and a lever 414*a* of a link member 414 (see FIG. 10). A covering member 413 is fixed to the base body of the driving unit 3 shown in FIG. 4 (see FIG. 4). Also, the covering member 413 has an opening (not shown) that allows the lever 414*a* to rotate within a range indicated by illustrated solid and broken lines. Remaining components of the driving-force switching mechanism 410 for developing device are described later. For convenience of the description, the description is returned to the driving-force switching mechanism 510 for photoconductor.

FIGS. 8A to 8C are each a perspective view of the driving-force switching mechanism 510 for photoconductor.

Figure 9A:
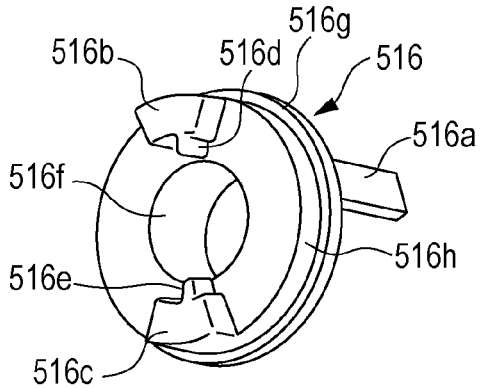
FIGS. 9A to 9C are perspective views of some major components of the driving-force switching mechanism for photoconductor.
Figure 9B:
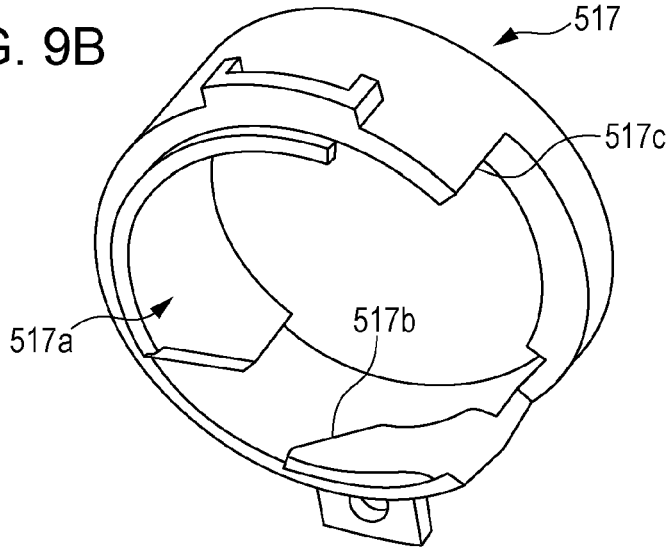
Figure 9C:
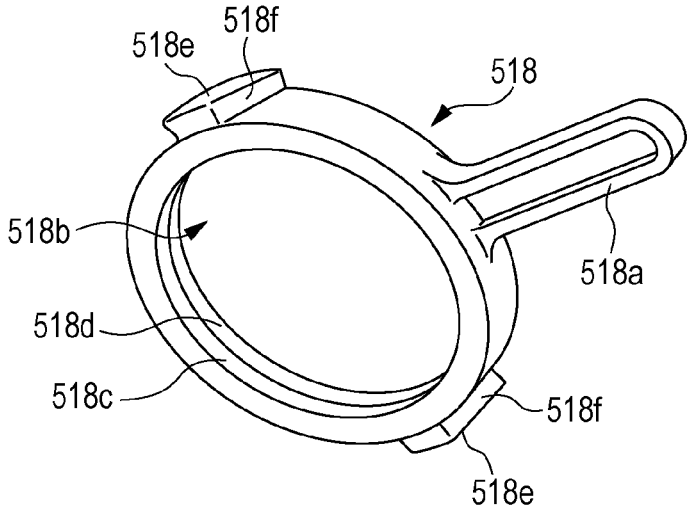

Also, FIGS. 9A to 9C are perspective views of some major components of the driving-force switching mechanism 510 for photoconductor. FIG. 9A shows the coupling member 516. FIG. 9B shows a covering member 517. FIG. 9C shows a link member 518.

FIG. 8A is a perspective view in a state in which all components of the driving-force switching mechanism 510 for photoconductor are assembled. FIG. 8A shows the covering member 517, and a lever 518*a* of the link member 518, in addition to the above-described driving gear 511K, transmission gear 512, and driving shaft 513. The covering member 517 is fixed to the base body of the driving unit 3 shown in FIG. 4 and hence is not movable. The covering member 517 has an opening 517*a* formed therein. The opening 517*a* allows the lever 518*a* of the link member 518 to protrude and to rotate between a rotation position indicated by solid lines and a rotation position indicated by broken lines in FIG. 8A. Also, FIG. 8A shows a coupling member 519 and a coil spring 520.

The coupling member 519 is a member that transmits the driving force when the driving shaft 513 rotates, to the photoconductor 51K (see FIG. 2). The coil spring 520 is a member that presses the coupling member 519 toward the distal end side of the driving shaft 513.

FIG. 8B is a perspective view when the covering member 517 and the link member 518 are removed from the driving-force switching mechanism 510 in the state in which the assembly is completed in FIG. 8A.

FIG. 8B shows the long hole 513*a* provided in the driving shaft 513, and the pin 515 inserted into the driving shaft 513 described with reference to FIG. 7. The pin 515 is fixed to the coupling member 516. Hence, the coupling member 516 is movable in the axial direction by the length of the long hole 513*a*.

Also, a coil spring 521 is provided at this position. The coil spring 521 presses the coupling member 516 to be pressed to the transmission gear 512.

Also, the coupling member 516 is provided with a coupling arm 516*a* extending rearward. The coupling arm 516*a* is inserted into a coupling hole 511*a* provided in the driving gear 511K. In this case, the driving gear 511K has two coupling holes 511*a*. Since the driving gear 511K and the transmission gear 512 have the same shape (see FIG. 7), commonality of parts is promoted.

Also, FIG. 8B shows another long hole 513*b* provided in the driving shaft 513. Another pin 522 is inserted into the long hole 513*b*. The pin 522 is fixed to the coupling member 519. Hence, the coupling member 519 is movable in the axial direction by the length of the long hole 513*b*. As described above, the coupling member 519 is pressed by the coil spring 520 forward (left side in FIG. 8B).

FIG. 8C is a perspective view when the transmission gear 512 is further removed from the state shown in FIG. 8B.

As described above, the transmission gear 512 is arranged at the position sandwiched between the two annular members 514*a* and 514*b* fixed to the driving shaft 513, and is rotatable relative to the driving shaft 513, but not movable in the axial direction.

FIG. 8C shows two protruding portions 516*b* and 516*c* formed at the coupling member 516 and protruding forward of the coupling member 516 (transmission gear 512 side). The protruding portions 516*b* and 516*c* protrude to have shapes that are respectively fitted to the two recessed portions 512*a* and 512*b* (see FIG. 7) provided in the transmission gear 512. Although the details are described later, one protruding portion 516*b* of the protruding portions 516*b* and 516*c* has a shape that is fitted to one recessed portion 512*a* of the two recessed portions 512*a* and 512*b* but is not fitted to the other recessed portion 512*b*. Similarly, the other protruding portion 516*c* has a shape that is fitted to the recessed portion 512*b* but is not fitted to the recessed portion 512*a*.

The coupling arm 516*a* extending rearward of the coupling member 516 has a shape that is fitted to any of the two coupling holes 511*a* provided in the driving gear 511K.

Next, the coupling member 516 shown in FIG. 9A, the covering member 517 shown in FIG. 9B, and the link member 518 shown in FIG. 9C are described.

The coupling member 516 shown in FIG. 9A is a substantially annular member having an opening 516*f* formed at the center. The driving shaft 513 penetrates through the opening 516*f*. As described above, the coupling member 516 has the coupling arm 516*a* extending rearward and the two protruding portions 516*b* and 516*c* protruding forward. The two protruding portions 516*b* and 516*c* have projections 516*d* and 516*e* projecting toward the center. The projections 516*d* and 516*e* are located at positions deviated from the rotationally symmetric positions. As shown in FIG. 7, the transmission gear 512 has formed therein the two recessed portions 512*a* and 512*b* to which the two protruding portions 516*b* and 516*c* provided at the coupling member 516 are fitted. The one recessed portion 512*a* of the two recessed portions 512*a* and 512*b* has a shape to which the one protruding portion 516*b* including the projection 516*d* of the two protruding portions 516*b* and 516*c* is fitted. The other protruding portion 516*c* is not fitted to the recessed portion 512*a* because the position of the projection 516*e* is different from the position of the projection 516*d* of the protruding portion 516*b*, and vice versa. In contrast, the coupling arm 516*a* extending rearward of the coupling member 516 has a cross-sectional shape substantially similar to those of the two protruding portions 516*b* and 516*c*, and does not have a projection corresponding to the projections 516*d* and 516*e*. Hence, the coupling arm 516*a* may be fitted to any of the two coupling holes 511*a* (see FIGS. 8A to 8C) of the driving gear 511K being the component common to the transmission gear 512.

As described above, the coupling member 516 is movable in the axial direction by the length of the long hole 513*a* provided in the driving shaft 513 as shown in FIGS. 8B and 8C. The coupling arm 516*a* of the coupling member 516 may be fitted to any of the two coupling holes 511*a*. The coupling arm 516*a* has a length so that the coupling arm 516*a* is not removed from fitted one of the coupling holes 511*a* even when the coupling member 516 moves in the axial direction after the assembly.

In contrast, the two protruding portions 516*b* and 516*c* protruding forward of the coupling member 516 are respectively fitted to the two recessed portions 512*a* and 512*b* of the transmission gear 512 when the coupling member 516 moves forward in the axial direction. When the coupling member 516 is in this state, the driving force of the driving gear 511K is transmitted to the transmission gear 512 through the coupling member 516. In contrast, when the coupling member 516 moves rearward in the axial direction, the two protruding portions 516*b* and 516*c* are removed from the two recessed portions 512*a* and 512*b* of the transmission gear 512, and the transmission of the driving force of the driving gear 511K to the transmission gear 512 is shut off. It may be conceived that, when the coupling member 516 moves toward the driving gear 511K side, the two protruding portions 516*b* and 516*c* of the coupling member 516 are removed once from the two recessed portions 512*a* and 512*b* of the transmission gear 512, and then the coupling member 516 moves again toward the transmission gear 512 side. At this time, as described above, since the fitting combinations between the two protruding portions 516*b* and 516*c* and the two recessed portions 512*a* and 512*b* are uniquely determined, the phase of the driving gear 511K and the transmission gear 512 (the mutual positional relationship in the rotation direction) is always restored to the original phase. The driving gear 511K takes charge of driving the photoconductor 51K of the image forming unit 50K, which is one of the four image forming units 50Y, 50M, 50C, and 50K. Also, the transmission gear 512 takes charge of receiving the driving force from the driving gear 511K and transmitting the driving force to the downstream three photoconductors 51Y, 51M, and 51C forming the three image forming units 50Y, 50M, and 50C. Hence, if the phase between the driving gear 511K and the transmission gear 512 is changed, due to a manufacturing error or an assembly error of the transmission gear 512, rotation of the photoconductor 51K directly driven by the driving gear 511K may be slightly shifted from rotation of the three photoconductors 51Y, 51M, and 51C driven through the transmission gear 512. Even if the transmission of the driving force through the transmission gear 512 has a slight shift, as long as the shift is constant, a correct image may be formed by correcting the slight shift in an image signal and then forming an electrostatic latent image. However, this correction may be applied only when the shift of the transmission of the driving force is constant. In this case, since the fitting combinations between the two protruding portions 516*b* and 516*c* of the coupling member 516 and the two recessed portions 512*a* and 512*b* of the transmission gear 512 are uniquely determined, the constant shift of the transmission of the driving force is assured.

Also, as shown in FIG. 9A, a flange portion 516*g* is provided at the rear side of the outer periphery of the coupling member 516. The flange portion 516*g* has a large width over the periphery. To correspond to this, the link member 518 shown in FIG. 9C has a flange portion 518*c* formed at the front side of the inner peripheral surface forming a center opening 518*b*. The flange portion 518*c* has a small width over the periphery and protruding inward. The coupling member 516 shown in FIG. 9A is fitted to the center opening 518*b* of the link member 518. The flange portion 516*g* of the coupling member 516 is fitted to a portion 518*d* located at the rear side of the flange portion 518*c* of the center opening 518*b* of the link member 518 and having a larger width than that of the flange portion 518*c*. Also, simultaneously, the flange portion 518*c* of the link member 518 is fitted to a portion 516*h* formed at the front side of the flange portion 516*g* at the outer periphery of the coupling member 516 and having a smaller width than that of the flange portion 516*g*.

Two protruding portions 518*e* are formed at positions mutually different by 180 degrees on the outer peripheral surface of the link member 518. One of standing walls forming each of the two protruding portions 518*e* is formed as an oblique surface 518*f* being oblique with respect to the axial direction. The link member 518 is fitted into the opening 517*a* of the covering member 517 shown in FIG. 9B. Also, an oblique surface 517*b* is formed at the inner peripheral surface forming the opening 517*a* of the covering member 517. The oblique surface 517*b* has a shape that meets the shape of the oblique surface 518*f* of the protruding portion 518*e* at the outer peripheral surface of the link member 518 shown in FIG. 9C. FIG. 9B shows only one oblique surface 517*b*; however, two oblique surfaces 517*b* are formed at positions respectively corresponding to the positions of the oblique surfaces 518*f* of the two protruding portions 518*e* of the link member 518. Also, the covering member 517 has an opening 517*c* that allows the lever 518*a* of the link member 518 to protrude and allows the link member 518 to rotate within a predetermined rotation range. The covering member 517 is fixed to the base body of the driving unit 3 (see FIG. 4).

The lever 518*a* of the link member 518 is pressed and moved when the driving-force switching member 610 shown in FIG. 6 moves in the directions indicated by arrows U and D. Accordingly, the link member 518 is rotated. Then, the oblique surfaces 518*f* at the outer peripheral surface of the link member 518 interfere with the oblique surfaces 517*b* at the inner peripheral surface of the covering member 517. The rotation of the link member 518 is converted into the movement in the axial direction of the link member 518. In this case, the coupling member 516 shown in FIG. 9A is pressed forward by the coil spring 521 as shown in FIGS. 8B and 8C. Hence, the link member 518 is also pressed forward in the axial direction through the coupling member 516 due to the interference between the flange portion 518*c* at the inner peripheral surface of the link member 518 and the flange portion 516*g* at the outer peripheral surface of the coupling member 516. In this way, when the coupling member 516 and the covering member 517 are pressed by the coil spring 521 and move forward in the axial direction, the protruding portions 516*b* and 516*c* of the coupling member 516 are fitted to the recessed portions 512*a* and 512*b* of the transmission gear 512, and hence the driving force is transmitted from the driving gear 511K to the transmission gear 512.

In this state, when the lever 518*a* of the link member 518 is operated by the movement of the driving-force switching member 610 and when the link member 518 is moved rearward in the axial direction due to the interference between the oblique surfaces 518*f* of the link member 518 and the oblique surfaces 517*b* of the covering member 517, the flange portion 518*c* of the link member 518 presses the flange portion 516*g* of the coupling member 516 rearward, and the coupling member 516 is also moved rearward against the force of the coil spring 521. By the rearward movement in the axial direction of the coupling member 516, the protruding portions 516*b* and 516*c* of the coupling member 516 are removed from the recessed portions 512*a* and 512*b* of the transmission gear 512, and the transmission of the driving force from the driving gear 511K to the transmission gear 512 is shut off.

The description of the driving-force switching mechanism 510 for photoconductor is ended, and the driving-force switching mechanism 410 for developing device (see FIGS. 6 and 7) is described next.

First, the above-described part of the driving-force switching mechanism 410 for developing device is briefly described again.

As shown in FIG. 6, the driving force from the first motor (see FIG. 4) is transmitted to the driving gear 411 forming the driving-force switching mechanism 410 through the transmission gear 401 and the intermediate gear 403*a*. Also, as shown in FIG. 7, the driving-force switching mechanism 410 includes the transmission gear 412 coaxially with the driving gear 411 of the driving-force switching mechanism 410. The state of the driving force from the driving gear 411 to the transmission gear 412 is switched between transmission and shut-off by the operation of the lever 414*a* of the link member 414 (see FIG. 10). When the driving force is transmitted from the driving gear 411 to the transmission gear 412, as shown in FIG. 6, the transmission gear 412 drives the driving gear 402C that drives the developing device 54C (see FIG. 2) of the image forming unit 50C. The driving force is further transmitted to the driving gear 402M that drives the developing device 54M (see FIG. 2) through the intermediate gear 403*b*. The driving force is further transmitted to the driving gear 402Y that drives the developing device 54Y (see FIG. 2) through the intermediate gear 403*c*.

Also, FIG. 7 shows the covering member 413 that covers the inside of the driving-force switching mechanism 410. The covering member 413 is fixed to the base body of the driving unit 3.

The driving-force switching mechanism 410 for developing device is further described below.

FIG. 10 is a perspective view showing the driving-force switching mechanism 410 for developing device when a covering member thereof is removed and the inner structure is viewed.

Figure 11A:
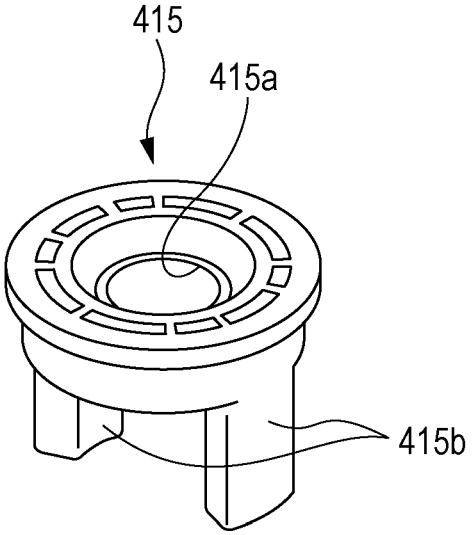
FIGS. 11A and 11B are perspective views, FIG. 11A showing a link member forming the driving-force switching mechanism for developing device, FIG. 11B showing a component common to a driving gear and a transmission gear.
Figure 11B:
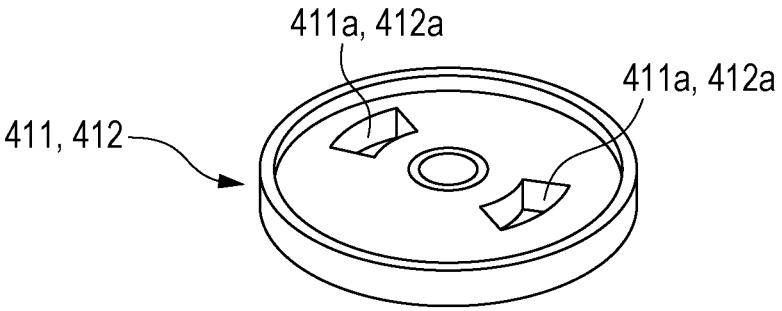

FIGS. 11A and 11B are perspective views, FIG. 11A showing the link member 411 forming the driving-force switching mechanism 410 for developing device, FIG. 11B showing a component common to the driving gear 411 and the transmission gear 412.

The driving-force switching mechanism 410 for developing device includes the covering member 413 shown in FIG. 7, the link member 414 shown in FIG. 10, a coupling member 415 shown in FIGS. 10 and 11A, and a coil spring 416 shown in FIG. 10 in addition to the driving gear 411 and the transmission gear 412. The structure of switching the state of the driving force from the driving gear 411 to the transmission gear 412 between transmission and shut-off, in the driving-force switching mechanism 410 for developing device is substantially similar to the switching structure in the driving-force switching mechanism 510 for photoconductor described with reference to FIGS. 8A to 9C, and therefore different points are described here.

The driving gear 411 and the transmission gear 412 are supported by a rotating shaft (not shown) and are mutually rotatable. The driving gear 411 and the transmission gear 412 are arranged at the same side in the axial direction when viewed from the coupling member 415. The link member 414 has a protruding portion 414*b* formed at the outer peripheral surface thereof. The protruding portion 414*b* has an oblique surface 414*c* at the wall surface of the protruding portion 414*b*. In contrast, an oblique surface (not shown) is formed at the inner peripheral surface of the covering member 413 shown in FIG. 7. This oblique surface interferes with the oblique surface 414*c*. The oblique surface 414*c* of the link member 414 interferes with the oblique surface at the inner peripheral surface of the covering member 413, and is moved in the axial direction by the movement of the lever 414*a*. The lever 414*a* enters an opening 619 of the driving-force switching member 610, and is operated by the movement of the driving-force switching member 610 in the directions indicated by arrows U and D (also see FIG. 6). Also, the coupling member 415 is a member formed in a substantially annular shape. As shown in FIG. 11A, the coupling member 415 has an opening 415*a*. The rotating shaft that rotatably supports the driving gear 411 and the transmission gear 412 is inserted into the opening 415*a*. As shown in FIG. 10, an upper portion of the opening 415*a* has a diameter that receives the coil spring 416; however, a lower portion of the opening 415*a* has a small diameter that allows only the rotating shaft to pass therethrough. The opening 415*a* has a wall that contacts the coil spring 416. Hence, the coil spring 416 presses the coupling member 415 toward the driving gear 411 side while being sandwiched between the covering member 413 (see FIG. 7) and the coupling member 415. The link member 414 is located at a position sandwiched between the coupling member 415 and the driving gear 411. The link member 414 is also pressed toward the driving gear 411 side.

As shown in FIG. 11A, the coupling member 415 has two coupling projections 415*b* projecting toward the driving gear 411 side. In contrast, as shown in FIG. 11B, the driving gear 411 and the transmission gear 412 each have two coupling holes 411*a* or 412*a* having shapes that meet the cross-sectional shapes of the two coupling projections 413*b* of the coupling member 415. The coupling projections 415*b* of the coupling member 415 each have a length that penetrates through the link member 414 arranged at the middle position with respect to the driving gear 411, and enters both the coupling holes 411*a* of the driving gear 411 and the coupling holes 412*a* of the transmission gear 412. Hence, when the coupling member 415 is pressed by the coil spring 416 and is moved toward the driving gear 411 side, the coupling projections 415*b* of the coupling member 415 enter the coupling holes 411*a* of the driving gear 411 and the coupling holes 412*a* of the transmission gear 412, and hence the driving force of the driving gear 411 is transmitted to the transmission gear 412.

When the lever 414*a* of the link member 414 is operated and the link member 414 is rotated, the oblique surface 414*c* at the outer peripheral surface of the link member 414 interferes with the oblique surface (not shown) at the inner peripheral surface of the covering member 413 (see FIG. 7), and the link member 414 is moved away from the driving gear 411. The coupling member 415 is also pressed by the link member 414, and is moved away from the driving gear 411 against the force of the coil spring 416. Then, the coupling projections 415*b* of the coupling member 415 are removed from the coupling holes 412*a* of the transmission gear 412, and hence the transmission of the driving force of the driving gear 411 to the transmission gear 412 is shut off. When the lever 414*a* of the link member 414 is operated in a reverse direction, the link member 414 and the coupling member 415 are pressed by the coil spring 416 and are moved toward the driving gear 411. The coupling projections 413*b* of the coupling member 415 are fitted to the coupling holes 412*a* of the transmission gear 412 in addition to the coupling holes 411*a* of the driving gear 411. Thus, the driving force of the driving gear 411 is transmitted to the transmission gear 412.

The driving-force switching mechanism 410 for developing device differs from the driving-force switching mechanism 510 for photoconductor in that the two coupling projections 413*b* of the coupling member 415 may be each fitted to any of the two coupling holes 411*a* of the driving gear 411 and the two coupling holes 412*a* of the transmission gear 412. This is because the driving of the developing device 54 is not as precise as the driving of the photoconductor 51. When the coupling protrusions 413*b* of the coupling member 415 are removed once from the coupling holes 412*a* of the transmission gear 412 and then are fitted again, even if the fitting relationship between the two coupling projections 413*b* and the two coupling holes 412*a* is inverted in the situation before the temporary removal from the situation after the fitting is attained again, this may not cause a serious problem.

Next, the driving-force switching mechanism 690 shown in FIG. 6 that moves the driving-force switching member 610 in the directions indicated by arrows U and D is described. The driving-force switching mechanism 690 includes the driving gear 601 that receives the driving force from the third motor 6 (see FIG. 4) and hence is driven. The third motor 6 is a motor that rotates only in one direction. Hence, the driving-force switching mechanism 690 has a mechanism that moves the driving-force switching member 610 in both the directions indicated by arrows U and D only by the rotation in one direction.

Figure 12:
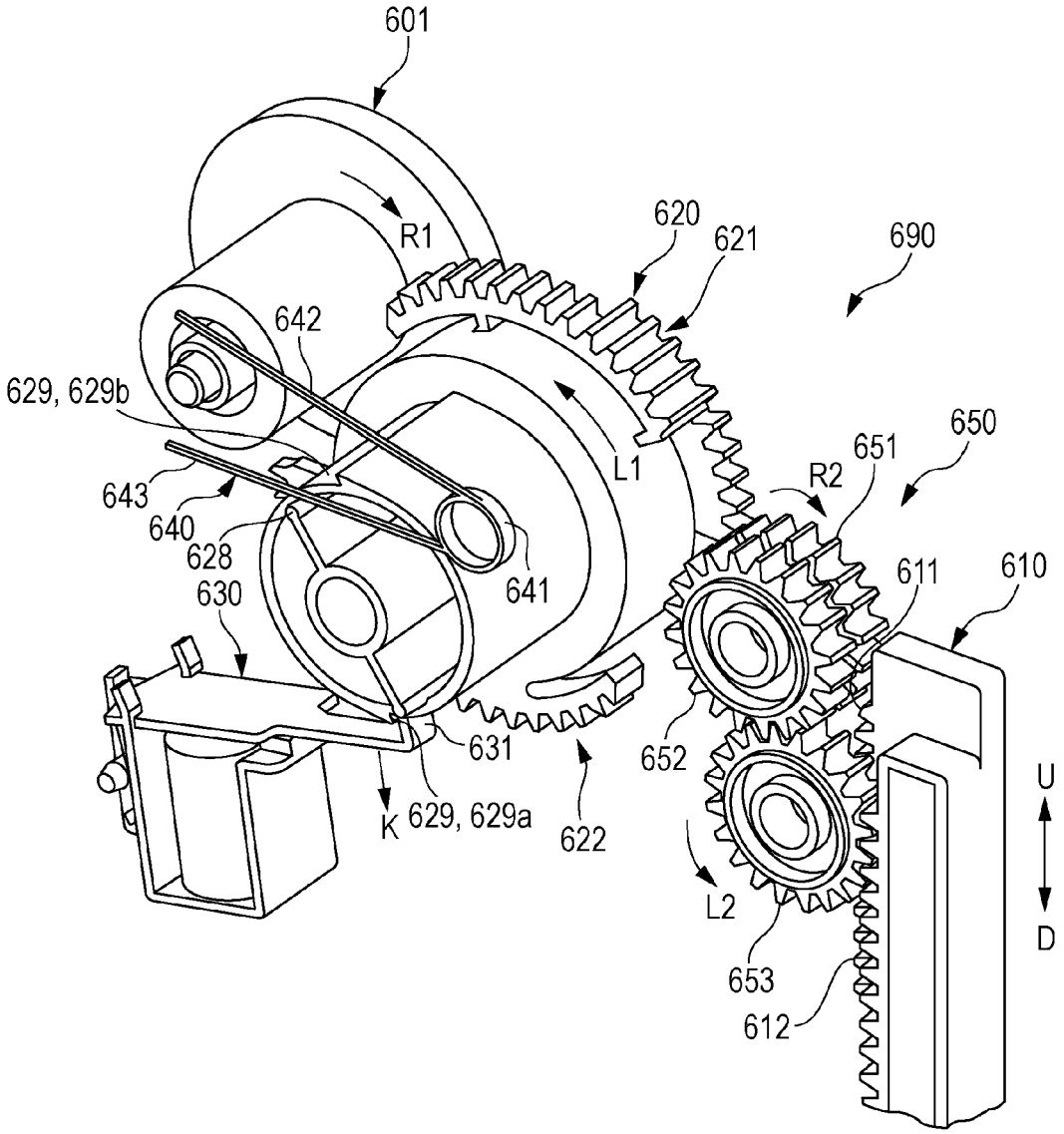
FIG. 12 is a perspective view of a driving-force switching mechanism that moves a driving-force switching member in directions indicated by arrows U and D.

FIG. 12 is a perspective view of the driving-force switching mechanism 610 that moves the driving-force switching member in the directions indicated by arrows U and D. FIG. 12 shows the driving-force switching mechanism 690 in an orientation substantially inverted to the orientation in FIG. 6.

The driving-force switching mechanism 690 shown in FIG. 12 includes a solenoid 630, a torsion spring 640, and a driving-force transmission section 650, in addition to the above-described driving gear 601, driving-force switching member 610, and tooth lacking gear 620. The driving-force transmission section 650 takes charge of transmitting the driving force of the tooth lacking gear 620 to the driving-force switching member 610.

The solenoid 630 is an element that intermittently drives the tooth lacking gear 620 together with the torsion spring 640. The solenoid 630 has a hook 631. The hook 631 is hooked to an engagement claw 629 of the tooth lacking gear 620. When the solenoid 630 is activated, the hook 631 moves in a direction to be disengaged from the engagement claw 629 (arrow K direction), and is disengaged from the engagement claw 629.

Also, the torsion spring 640 has a shape in which two arms 642 and 643 extend form a base portion 641 wound in a circular shape. The circular base portion 641 is non-movably fixed to the base body of the driving unit 3 (see FIG. 4). Also, the position of one arm 642 of the two arms 642 and 643 is restricted by the base body. The other arm 643 of the two arms 642 and 643 presses an activation portion 628 protruding in the axial direction in a flat plate shape, counterclockwise of the tooth lacking gear 620 (direction indicated by an arrow L1). Accordingly, the engagement (hooking) of the hook 631 of the solenoid 630 to the engagement claw 629 is assured.

Although the details are described later, the tooth lacking gear 620 has a first tooth row 621 and a second tooth row 622 each having a length smaller than a half of the periphery. The first tooth row 621 and the second tooth row 622 are provided at positions deviated from each other in the axial direction of the tooth lacking gear 620.

Also, the driving-force transmission section 650 includes a first gear 651 and a second gear 652 that are coaxially arranged and overlap each other in the axial direction, and a third gear 653 that meshes with the second gear 652 which is one of the first gear 651 and the second gear 652. The first gear 651 and the second gear 652 are coaxially arranged; however, the first gear 651 and the second gear 652 are rotatable about the axis independently from each other.

Also, the driving-force switching member 610 includes a first rack tooth row 611 that meshes with the first gear 651, and a second rack tooth row 612 that meshes with the third gear 653.

When the solenoid 630 is activated, the hook 631 of the solenoid 630 is disengaged from the engagement claw 629 of the tooth lacking gear 620. Then, since the activation portion 628 of the tooth lacking gear 620 is pressed by the torsion spring 640, the tooth lacking gear 620 starts rotating in the arrow L1 direction. By the initial rotation, one of the first tooth row 621 and the second tooth row 622 of the tooth lacking gear 620 (the first tooth row 621 in the state shown in FIG. 12) meshes with the driving gear 601 that rotates in a direction indicated by an arrow R1. Then, the tooth lacking gear 620 receives the driving force from the driving gear 601, and continuously rotates in the arrow L1 direction. Then, the other one of the first tooth row 621 and the second tooth row 622 (the second tooth row 622 in the state shown in FIG. 12) meshes with one of the first gear 651 and the second gear 652 (the second gear 652 in the state shown in FIG. 12). With the meshing, in the state shown in FIG. 12, the second gear 652 rotates in a direction indicated by arrow R2, and the third gear 653 meshing with the second gear 652 rotates in a direction indicated by an arrow L2. Then, the rotation of the third gear 653 is transmitted to the second rack tooth row 612, and moves the driving-force switching member 610 in the direction indicated by the arrow U. At this time, even if the first gear 651 meshes with the first rack tooth row 611, since the first gear 651 freely rotates independently from the second gear 652, the meshing between the first gear 651 and the first rack tooth row 611 does not interrupt the movement of the driving-force switching member 610 in the direction indicated by the arrow U.

After the solenoid 630 is activated once, the operation of the solenoid 630 is stopped before the tooth lacking gear 620 rotates by 180 degrees. With the stop, the hook 631 is pressed to the peripheral surface of the tooth lacking gear 620.

The engagement claw 629 of the tooth lacking gear 620 has a first engagement claw 629*a* and a second engagement claw 629*b* provided at positions mutually different from each other by 180 degrees. FIG. 12 shows a first initial state in which the hook 631 is hooked to the first engagement claw 629*a*. When the tooth lacking gear 620 rotates by 180 degrees by the above-described operation from the first initial state shown in FIG. 12, the hook 631 is hooked to the second engagement claw 629*b*. Accordingly, the state becomes a second initial state in which the positions of the first tooth row 621 and the second tooth row 622 of the tooth lacking gear 620 are switched from one another from the position shown in FIG. 12. As described above, the first tooth row 621 and the second tooth row 622 are located at positions mutually deviated in the axial direction. Hence, when the similar operation is started from the second initial state, the second tooth row 622 of the tooth lacking gear 620 meshes with the driving gear 601, and the first tooth row 621 meshes with the first gear 651. At this time, the driving-force switching member 610 has been moved in the arrow U direction. Since the rotation in the arrow R2 direction of the first tooth row 621 is transmitted to the first rack tooth row 611, the driving-force switching member 610 moves in the arrow D direction. At this time, since the second gear 652 is freely rotatable independently from the first gear 651, even if the third gear 653 meshing with the second gear 652 meshes with the second rack tooth row 612, the meshing does not interrupt the movement of the driving-force switching member 610 in the arrow D direction.

In the driving-force switching mechanism 690, by alternately repeating the first initial state and the second initial state, the up-down movement of the driving-force switching member 610 is repeated while the driving gear 601 that rotates only in the R1 direction serves as a driving source. With the up-down movement of the driving-force switching member 610, the driving is switched between the monochrome mode and the color mode.

FIGS. 13A to 13D show shapes of the tooth lacking gear 620 when the tooth lacking gear 620 forming the driving-force switching mechanism 690 shown in FIG. 12 is viewed at various angles.

The tooth lacking gear 620 receives the driving force from the driving gear 601 and rotates in the arrow L1 direction shown in each of FIGS. 13A to 13D.

Figure 13A:
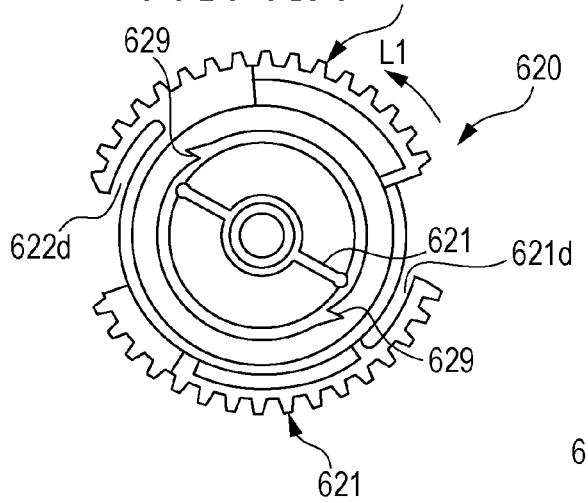
FIGS. 13A to 13D show shapes of a tooth lacking gear when the tooth lacking gear forming the driving-force switching mechanism shown in FIG. 12 is viewed at various angles.
Figure 13B:
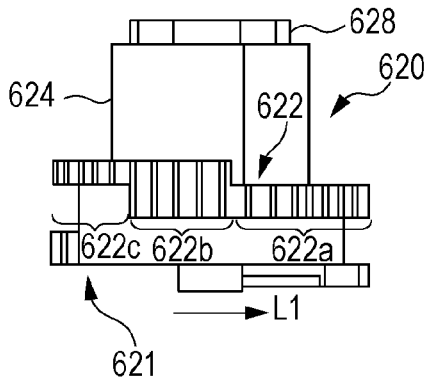
Figure 13C:
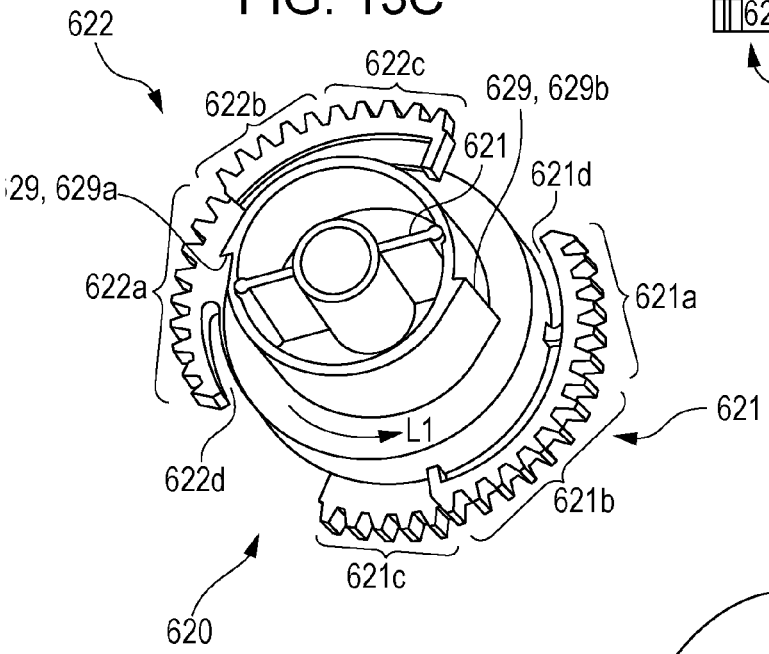
Figure 13D:
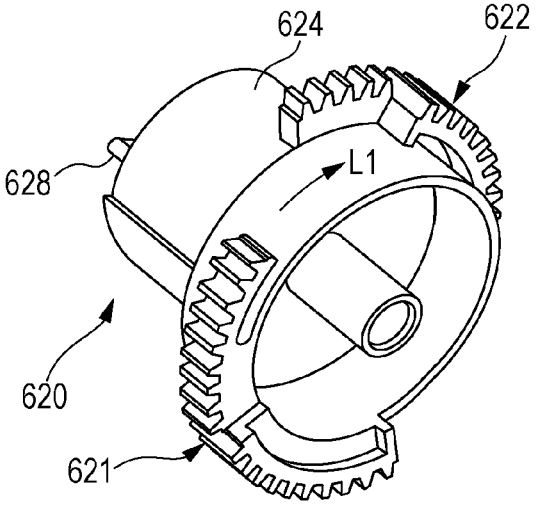

FIG. 13B clearly illustrates the shape of the second tooth row 622. Hence, the second tooth row 622 is described first. The second tooth row 622 has a front end portion 622*a*, an intermediate portion 622*b*, and a rear end portion 622*c* in order from the front end side in the rotation direction (arrow L1 direction). The front end portion 622*a* and the rear end portion 622*c* are provided at mutually deviated positions in the rotation-axis direction. The intermediate portion 622*b* is a wide tooth row in the rotation-axis direction in which an extension portion of the front end portion 622*a* and an extension portion of the rear end portion 622*c* are combined. A notch 622*d* (see FIGS. 13A and 13C) is formed at the foremost end portion of the front end portion 622*a*. The second tooth row 622 starts meshing with the driving gear 601 and the second gear 652 from the front end side in the rotation direction (arrow L1 direction). Hence, at the start of the meshing, smooth meshing may not be occasionally provided, for example, when mountains of teeth contact each other. When smooth meshing is not provided, the notch 622*d* causes the foremost end portion of the front end portion 622*a* to be bent, to absorb the shock at the start of the meshing. Also, when the second tooth row 622 meshes with the second gear 652, the front end portion 622*a* and the intermediate portion 622*b* take charge of meshing with the second gear 652. The rear end portion 622*c* is provided at a position deviated in the rotation-axis direction so as not to mesh with the second gear 652. In contrast, when the second tooth row 622 meshes with the driving gear 601, the whole length including the front end portion 622*a*, the intermediate portion 622*b*, and the rear end portion 622*c* takes charge of meshing with the driving gear 601. This reason is described after the description of the first tooth row 621.

The first tooth row 621 is entirely provided at a position different from the position of the second tooth row 622 in the rotation-axis direction. Similarly to the second tooth row 622, the first tooth row 621 has a front end portion 621*a*, an intermediate portion 621*b*, and a rear end portion 621*c* in order from the front end side in the rotation direction (arrow L1 direction). The front end portion 621*a* and the rear end portion 621*c* are provided at mutually deviated positions in the rotation-axis direction. However, the deviation direction of the rear end portion 621*c* with respect to the front end portion 621*a* in the rotation-axis direction is a direction reversal to the deviation direction of the rear end portion 622*c* with respect to the front end portion 622*a* of the second tooth row 622. This is to avoid the rear end portion 621*c* of the first tooth row 621 from interfering with the second gear 652, and to avoid the rear end portion 622*c* of the second tooth row 622 from interfering with the first gear 651, since the first tooth row 621 and the second tooth row 622 respectively mesh with the first gear 651 and the second gear 652 in an assigned manner. A notch 621*d* is formed at the foremost end portion of the front end portion 621*a* of the first tooth row 621, similarly to the foremost end portion of the second tooth row 622. The intermediate portion 621*b* of the first tooth row 621 has a wide shape in the rotation-axis direction in which an extension portion of the front end portion 621*a* and an extension portion of the rear end portion 621*c* are combined, similarly to the intermediate portion 622*b* of the second tooth row 622. In the first tooth row 621, the front end portion 621*a* and the intermediate portion 621*b* take charge of meshing with the first gear 651, and the rear end portion 621*c* is provided at a position not meshing with the first gear 651, similarly to the second tooth row 622. Even in the first tooth row 621, when the first tooth row 621 meshes with the driving gear 601, the whole length including the front end portion 621*a*, the intermediate portion 621*b*, and the rear end portion 621*c* takes charge of meshing with the driving gear 601.

In this case, a situation is considered in which the first tooth row 621 of the tooth lacking gear 620 meshes with the driving gear 601, and the second tooth row 622 meshes with the second gear 652. The meshing between the second tooth row 622 and the second gear 652 starts from the front end portion 622*a* of the second tooth row 622, the meshing is shifted to the intermediate portion 621*b*, the meshing between the second tooth row 622 and the second gear 652 is ended at the rear end of the intermediate portion 621*b*, and the rotation of the second gear 652 is stopped at this time. However, the rear end portion 621*c* of the first tooth row 621 continuously meshes with the driving gear 601 even thereafter, the tooth lacking gear 620 is continuously rotated, and the state is shifted to the initial state after the tooth lacking gear 620 is rotated by 180 degrees. The meshing is provided similarly to the above-described situation when the role of meshing is exchanged from the first tooth row 621 to the second tooth row 622, the second tooth row 622 meshes with the driving gear 601, and the first tooth row 621 meshes with the first gear 651. The tooth lacking gear 620 is provided with the first tooth row 621 and the second tooth row 622 having the complex shapes as shown in FIGS. 13A to 13D. This is because the tooth lacking gear 620 has to be further rotated to be restored to the initial state after the first gear 651 or the second gear 652 and the third gear 653 are rotated by required rotation amounts and stopped.

The operation of the driving-force switching mechanism 690 from the initial state shown in FIG. 12 is described below again with reference to the drawings.

Figure 14:
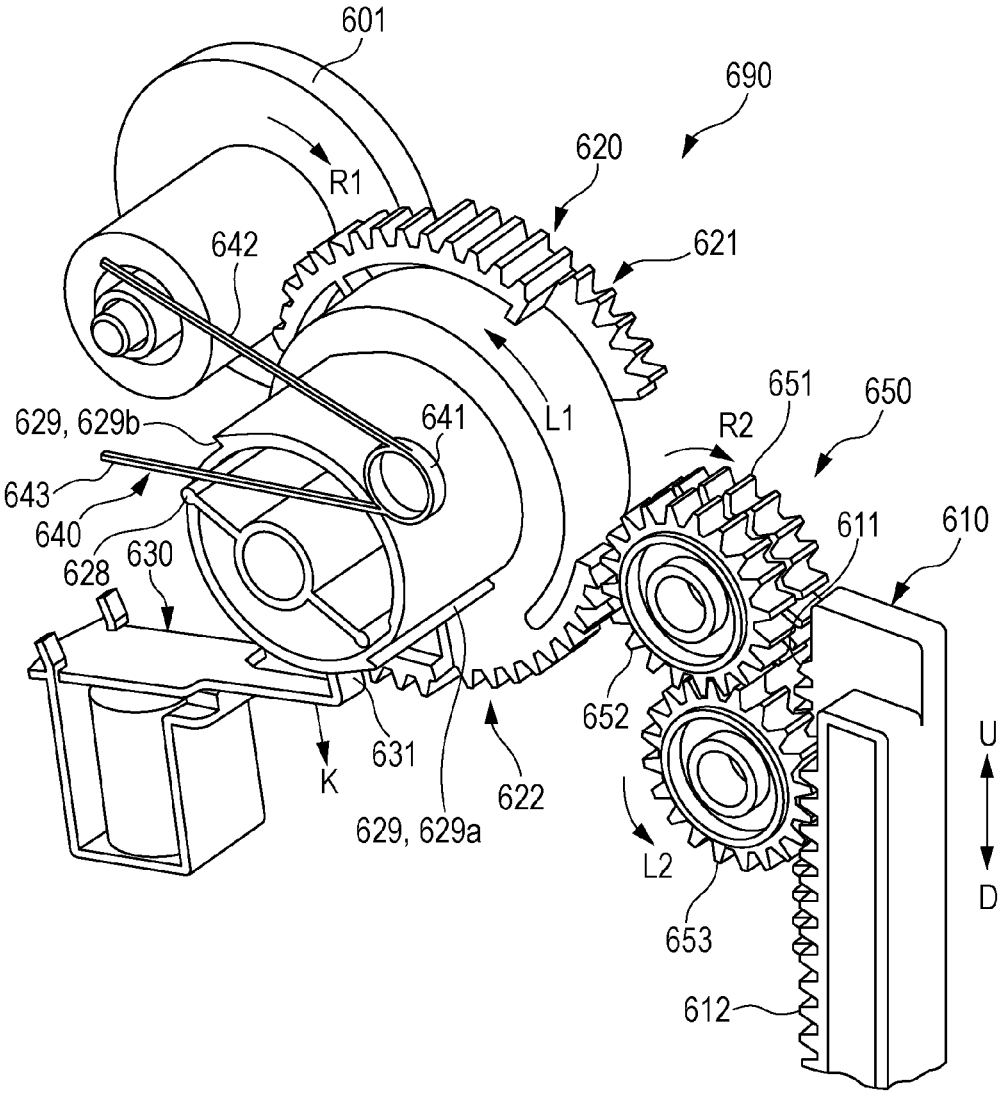
FIG. 14 is a perspective view showing the driving-force switching mechanism in a state immediately after operation is started from a first initial state shown in FIG. 12.

FIG. 14 is a perspective view showing the driving-force switching mechanism 690 in a state immediately after operation is started from the first initial state shown in FIG. 12.

FIG. 14 shows a state in which the hook 631 of the solenoid 630 is disengaged from the engagement claw 629*a* of the tooth lacking gear 620, the tooth lacking gear 620 is pressed by the torsion spring 640 and starts rotating in the arrow L1 direction, and the first tooth row 621 starts meshing with the driving gear 601. At a timing at which several teeth at the leading end of the first tooth row 621 mesh with the driving gear 601 and the meshing becomes stable, the second tooth row 622 starts meshing with the second gear 652 and the second gear 652 starts rotating. The rotation of the second gear 652 is transmitted to the third gear 653. With the rotation of the third gear 653, the movement of the driving-force switching member 610 in the arrow U direction is started.

Figure 15:
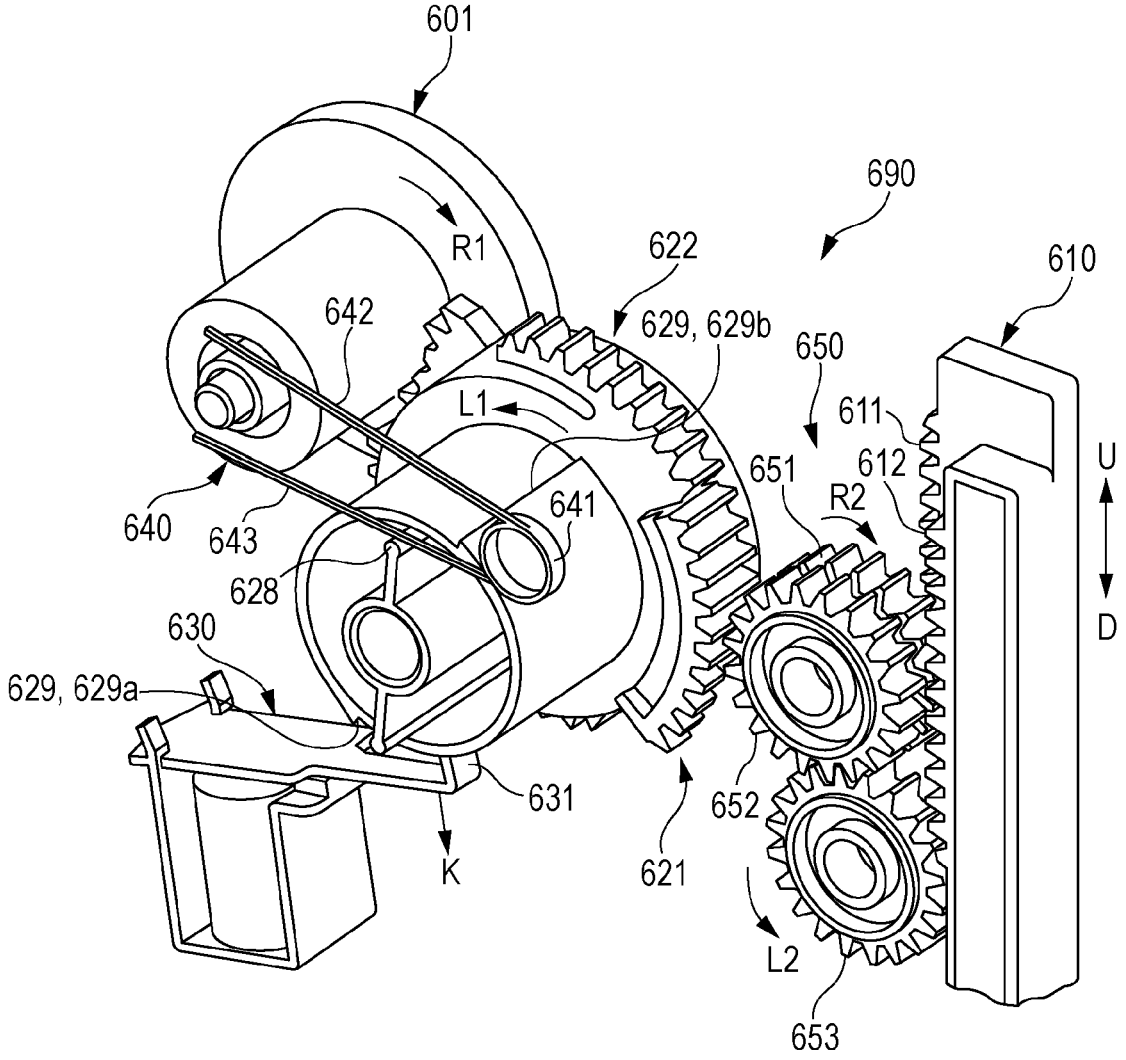
FIG. 15 is a perspective view showing the driving-force switching mechanism in a state in which rotation of the tooth lacking gear is advanced as compared with the state shown in FIG. 14.

FIG. 15 is a perspective view showing the driving-force switching mechanism 690 in a state in which rotation of the tooth lacking gear 620 is advanced as compared with the state shown in FIG. 14.

As compared with FIG. 14, the driving-force switching member 610 further moves in the arrow U direction by an amount of advancement of the rotation of the tooth lacking gear 620. In this case, the second gear 652 meshes with the rear end of the intermediate portion 622*b* (see FIGS. 13A to 13D) of the second tooth row 622, and hence is immediately before the meshing with the second tooth row 622 is disengaged. Hence, the driving-force switching member 610 stops the movement in the arrow U direction at this time. However, the rear end portion 621*c* of the first tooth row 621 still meshes with the driving gear 601, and with the meshing, the tooth lacking gear 620 is further continuously driven by the driving gear 601 and continues the rotation.

Figure 16:
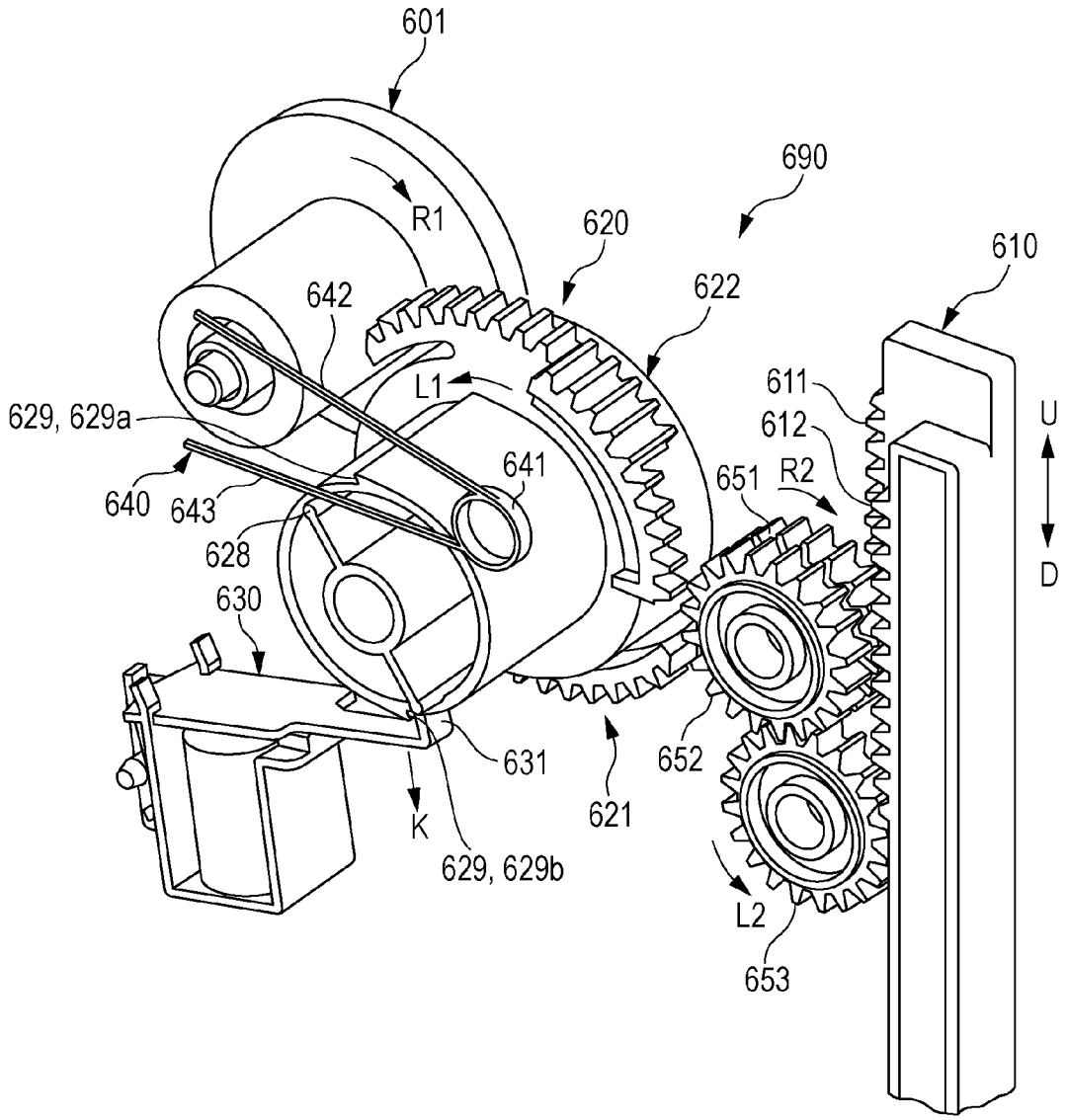
FIG. 16 is a perspective view showing the driving-force switching mechanism when the tooth lacking gear is rotated by 180 degrees and the state is shifted to a second initial state.

FIG. 16 is a perspective view showing the driving-force switching mechanism 690 when the tooth lacking gear 620 is rotated by 180 degrees and the state is shifted to the second initial state.

The meshing between the rear end portion 621*c* of the first tooth row 621 and the driving gear 601 is disengaged immediately before the tooth lacking gear 620 is shifted to the second initial state shown in FIG. 16. Then, the tooth lacking gear 620 is pressed by the torsion spring 640 and rotates to the second initial state shown in FIG. 16. In the second initial state shown in FIG. 16, as compared with the first initial state shown in FIG. 12, the positions of the first tooth row 621 and the second tooth row 622 of the tooth lacking gear 620 are switched. Also, the driving-force switching member 610 has been moved in the arrow U direction. When the operation is started from the second initial state, with the operation similar to the above-described operation, the second tooth row 622 of the tooth lacking gear 620 meshes with the driving gear 601, the first tooth row 621 meshes with the first gear 651, and the driving-force switching member 610 moves in the arrow D direction at this time. Then, with the rotation of the tooth lacking gear 620 by 180 degrees, the state becomes the first initial state shown in FIG. 12.

Referring back to FIG. 6, the description is additionally provided.

The driving-force switching member 610 forming the driving-force switching mechanism 690 includes a third rack tooth row 613 in addition to the above-described first rack tooth row 611 and second rack tooth row 612. The driving-force switching mechanism 690 also includes a fourth gear 654 that meshes with the third rack tooth row 613. The fourth gear 654 is a gear that meshes with the third rack tooth row 613 and rotates, operates a cam mechanism (not shown), and executes switching of the movement path of the intermediate transfer belt 61 as described above with reference to FIG. 2. That is, with the rotation of the fourth gear 654, switching is executed between the path of circulation while contact is made with the four photoconductors 51Y, 51M, 51C, and 51K in the color mode, and the path of circulation while contact is made with only the single photoconductor 51K in the monochrome mode.

In this way, with the movement of the driving-force switching member 610 by the driving-force switching mechanism 690, switching of all members required to be switched between the color mode and the monochrome mode are executed.

It is to be noted that the examples of the structures of transmission and switching for the driving force are described with reference to the respective drawings of FIG. 6 and later. However, the invention may employ other example as long as the arrangement of the motor and the arrangement of the circuit board are efficiently distributed as shown in FIGS. 3 and 4. Hence, specific transmission mechanisms and switching mechanisms for the driving force are not limited to those exemplified above.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a plurality of arrayed image forming units, each of the image forming units including a photoconductor on which an electrostatic latent image is formed and a toner image is formed by development while the photoconductor rotates by receiving a driving force, and a developing device that operates by receiving a driving force, and develops the electrostatic latent image on the photoconductor with a toner;

an intermediate transfer body that circulates on a circulation path including a partial path extending along the plurality of photoconductors forming the plurality of image forming units by receiving a driving force, receives first transfer of the toner images formed on the photoconductors, and transport the toner images to a second transfer position;

a fixing device that operates by receiving a driving force, and fixes the toner images to a sheet of paper, the toner images which are transferred on the sheet from the intermediate transfer body when the toner images pass through the second transfer position;

a driving unit including a motor mount section that extends in a first region overlapping a first image forming unit located at a first end among the plurality of image forming units in a rotation-axis direction of the photoconductors, and has mounted thereon a plurality of motors that drive the plurality of photoconductors and the plurality of developing devices forming the plurality of image forming units, the intermediate transfer body, and the fixing device, in an assigned manner, and a driving-force transmission section that extends in a second region overlapping the other image forming units excluding the first image forming unit among the plurality of image forming units in the rotation-axis direction of the photoconductors, and has assembled therein a driving-force transmission mechanism that transmits a driving force to the photoconductors and the developing devices forming the other image forming units; and a circuit board having mounted thereon a circuit component that controls electric power for operating the driving unit, the circuit board being arranged at a position to avoid overlapping the motor mount section and to overlap the driving-force transmission section in the rotation-axis direction of the photoconductors.

2. The image forming apparatus according to claim 1, wherein the driving unit has a unit substrate that extends entirely in the first region and the second region and supports the plurality of motors in the first region and supports the driving-force transmission mechanism in the second region, and the driving-force transmission section is thinner than the motor mount section in the rotation-axis direction of the photoconductors, and wherein the circuit board is arranged at a position to overlap the driving-force transmission section in the rotation-axis direction of the photoconductors and to reduce a difference between a thickness of the driving-force transmission section and a thickness of the motor mount section, and is fixed to the driving-force transmission section.

3. The image forming apparatus according to claim 1, further comprising a driving-force switching mechanism that is driven by any one of the plurality of motors and switches a state of a driving force to the driving-force transmission section between transmission and shut-off.

4. The image forming apparatus according to claim 3, wherein the plurality of motors include a first motor serving as a driving source for the plurality of developing devices forming the plurality of image forming units, and a second motor serving as a driving source for the plurality of photoconductors forming the plurality of image forming units, wherein the driving-force transmission mechanism includes a first transmission mechanism that transmits a driving force of the first motor to the developing devices of the other image forming units, and a second transmission mechanism that transmits a driving force of the second motor to the photoconductors of the other image forming units, and wherein the driving-force switching mechanism takes charge of transmission and shut-off of the driving force of the first motor to the first transmission mechanism, and transmission and shut-off of the driving force of the second motor to the second transmission mechanism.

* * * * *